US012076623B2

(12) United States Patent
Morales et al.

(10) Patent No.: US 12,076,623 B2
(45) **Date of Patent: *Sep. 3, 2024**

(54) GOLF CLUB HEADS WITH STIFFENING RIBS

(71) Applicant: KARSTEN MANUFACTURING CORPORATION, Phoenix, AZ (US)

(72) Inventors: Eric J. Morales, Laveen, AZ (US); Cory S. Bacon, Cave Creek, AZ (US); Jeremy S. Pope, Overland Park, KS (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 47 days.

This patent is subject to a terminal disclaimer.

(21) Appl. No.: 17/752,739

(22) Filed: May 24, 2022

(65) Prior Publication Data

US 2022/0280844 A1 Sep. 8, 2022

Related U.S. Application Data

(63) Continuation of application No. 17/241,804, filed on Apr. 27, 2021, now Pat. No. 11,338,182, which is a (Continued)

(51) Int. Cl.
*A63B 53/04* (2015.01)

(52) U.S. Cl.
CPC ..... *A63B 53/0466* (2013.01); *A63B 53/0408* (2020.08); *A63B 53/0437* (2020.08); *A63B 53/0454* (2020.08)

(58) Field of Classification Search
CPC ..... A63B 53/0466; A63B 53/0408; A63B 53/0437; A63B 53/0454; A63B 53/045
(Continued)

(56) References Cited

U.S. PATENT DOCUMENTS 5,295,689 A 3/1994 Lundberg
5,643,107 A 7/1997 Gorman
(Continued)

FOREIGN PATENT DOCUMENTS

| | | |
|---|---|---|
| JP | 2008148762 | 7/2008 |
| JP | 2016106886 | 6/2016 |
| WO | 2001008757 | 2/2001 |

OTHER PUBLICATIONS

Feb. 28, 2020—(WO) International Search Report and Written Opinion—App PCT/US2019/068183—18 pages.

*Primary Examiner* — Sebastiano Passaniti

(57) ABSTRACT

Disclosed herein is a hollow golf club head comprising a first component adhered to a second component. The first component comprises: a crown return and a sole return extending rearwardly from the strikeface, a sole extension extending rearwardly from the sole return and forming a portion of the sole, a back rail connected to the sole extension, a skirt connected to the back rail, and a rib positioned on an interior surface of the golf club head. The crown return forms a portion of the crown. The sole return forms a portion of the sole. The rib comprises a lower front end point, a lower rear end point, an upper rear end point, a bottom edge and a top edge. The rib height varies between the lower front end point and the lower rear end point. The rib extends from channel configured to receive a weight portion, to the crown.

19 Claims, 16 Drawing Sheets

Related U.S. Application Data continuation of application No. 16/724,176, filed on Dec. 20, 2019, now Pat. No. 10,987,551, which is a continuation-in-part of application No. 16/215,474, filed on Dec. 10, 2018, now Pat. No. 10,596,427.

(60) Provisional application No. 62/878,263, filed on Jul. 24, 2019, provisional application No. 62/855,751, filed on May 31, 2019, provisional application No. 62/784,190, filed on Dec. 21, 2018, provisional application No. 62/784,265, filed on Dec. 21, 2018, provisional application No. 62/596,677, filed on Dec. 8, 2017.

(58) Field of Classification Search
USPC ..... 473/324–350, 287–292
See application file for complete search history.

(56) References Cited

U.S. PATENT DOCUMENTS

| | | | |
|---|---|---|---|
| 5,718,641 | A | 2/1998 | Lin |
| 5,941,782 | A | 8/1999 | Cook |
| 6,059,669 | A | 5/2000 | Pearce |
| 6,422,951 | B1 | 7/2002 | Burrows |
| 6,872,153 | B2 | 3/2005 | Gilbert et al. |
| 6,878,073 | B2 | 4/2005 | Takeda |
| 7,056,228 | B2 | 6/2006 | Beach et al. |
| 7,530,901 | B2 | 5/2009 | Imamoto et al. |
| 7,611,424 | B2 | 11/2009 | Nagai et al. |
| 7,854,666 | B2 | 12/2010 | Horacek et al. |
| 7,938,740 | B2 | 5/2011 | Breier et al. |
| 8,016,694 | B2 | 9/2011 | Llewellyn et al. |
| 8,033,932 | B2 | 10/2011 | Wada et al. |
| 8,323,121 | B2 | 1/2012 | Wada et al. |
| 8,409,030 | B2 | 4/2013 | Hoffman et al. |
| 8,444,506 | B2 | 5/2013 | Watson et al. |
| 8,506,421 | B2 | 8/2013 | Stites et al. |
| 8,702,533 | B2 | 4/2014 | Evans |
| 8,864,604 | B2 | 10/2014 | Matsunaga |
| 9,072,949 | B2 | 7/2015 | Stites et al. |
| 9,498,684 | B2 | 11/2016 | Motokawa |
| 9,700,764 | B2 | 7/2017 | Carter |
| 9,700,765 | B2 | 7/2017 | Frame et al. |
| 9,776,054 | B2 | 10/2017 | Horacek et al. |
| 9,789,371 | B2 | 10/2017 | Boggs et al. |
| 9,901,794 | B2 | 2/2018 | Beno et al. |
| 10,258,842 | B2 | 4/2019 | Sander |
| 10,300,358 | B2 | 5/2019 | Boggs |
| 10,343,031 | B1 | 7/2019 | Day et al. |
| 10,987,551 | B2 | 4/2021 | Morales et al. |
| 11,338,182 | B2 * | 5/2022 | Morales ..... A63B 60/02 |
| 2008/0102978 | A1 | 5/2008 | Burnett |
| 2015/0290504 | A1 | 10/2015 | Zheng |

* cited by examiner

GOLF CLUB HEADS WITH STIFFENING RIBS

CROSS REFERENCE TO RELATED APPLICATIONS

This is a continuation of U.S. Non-Provisional application Ser. No. 17/241,804, filed Apr. 27, 2021, now U.S. Pat. No. 11,338,182 which is a continuation of U.S. Non-Provisional application Ser. No. 16/724,176, filed Dec. 20, 2019, now U.S. Pat. No. 10,987,551 which claims the benefit of U.S. Provisional Application No. 62/878,263, filed Jul. 24, 2019, U.S. Provisional Application No. 62/855,751, filed May 31, 2019, U.S. Provisional Application No. 62/784,265, filed Dec. 21, 2018, and U.S. Provisional Application No. 62/784,190, filed Dec. 21, 2018, and is a continuation-in-part of U.S. Non-Provisional application Ser. No. 16/215,474, filed Dec. 10, 2018, now U.S. Pat. No. 10,596,427, which claims the benefit of U.S. Provisional Application No. 62/596,677, filed Dec. 8, 2017, wherein the contents of all above-described disclosures are incorporated herein by reference in their entirety.

FIELD OF THE INVENTION

The present disclosure relates to golf club heads with structures or ribs that reinforce the club head.

BACKGROUND

In general, there are many important physical parameters (i.e., volume, mass, etc.) that effect the overall performance of the golf club head. One of the most important physical parameters is the center of gravity (CG) of the golf club head. The CG of the golf club head directly affects the performance characteristics (i.e., moment of inertia, launch, ball speed, etc.). A desirable CG position on a golf club head is low and rearward from the strikeface, to optimally raise the launch angle and MOI of the golf ball. Additionally, the CG position can be moved nearer to the toe end or heel end of the golf club head to further affect the side spin of the golf ball.

Typically, wood-type golf clubs are made exclusively of metal. In these club heads, the hollow-shell body comprises a thick face for ball impact and a thick sole to withstand grazing impact. The remaining portions of the club are manufactured to be as thin as possible for weight savings. Recently, however, light weight composite and plastic materials have been implemented in the hollow shell construction of the golf clubs to further increase weight savings. The above mentioned weight savings allow for mass to be localized through the use of external weights. Material weight savings and mass localization can allow for optimal CG and MOI characteristics.

In addition to providing material weight savings, and ideal CG and MOI characteristics, golf club heads comprising light weight materials and weight systems must continue to fulfil the consumer expected wear life on the club. Ribs have often been employed in the prior art to add desired rigidity to the crown and sole of the club for light weight support. These ribs serve to strengthen the club head body in locations of high stress.

The prior art fails to recognize that club heads comprising both lightweight materials and a localized mass require additional support due to oscillatory club head motion after impact.

DESCRIPTION

Figure 1:
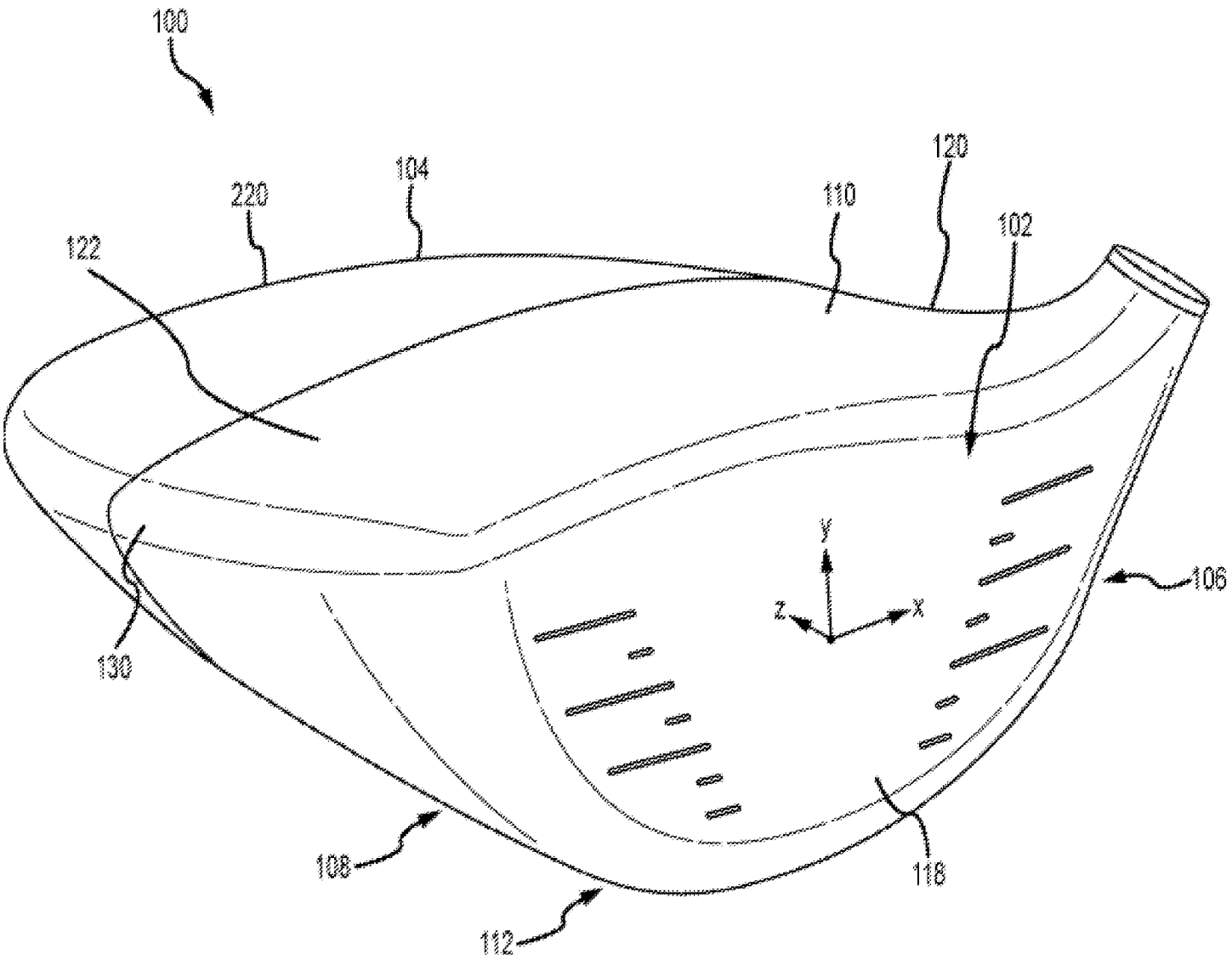
FIG. 1 illustrates a front perspective view of a golf club head according to an embodiment.

I. Multi-Material Golf Club Head with Ribs

A. Introduction

Described herein is a multi-material golf club having at stiffening rib, operative for supporting a weight system located in the club head rear during impact. The multi-material golf club head can be a hollow golf club body. The hollow golf club head body is defined by a first component and a second component coupled together. The first component is fabricated from a metal material. The second component is fabricated from a nonmetallic, composite material. The first component comprises the weight system. The weight system comprises a weight portion having a large mass fixed and a rear most point on the club body. Additionally, the weight system is confined within a small arced region in club head rear.

The restricted location and heavy mass of the weight system combine to allow for the center of gravity (CG) to be moved in toward the heel or toward the toe without also moving the CG forward. Golf club heads comprising the above structure, however, tend to reach fatigue failure at an accelerated rate when compared to golf club heads comprising a single material construction and a larger region for weight placement. Following impact with a golf ball, the body of the club head recoils. During recoil, the club head bends and deforms elastically at the location of the weight system. The restoration of the club to its original position causes the club head to oscillate near the weight system. In general, oscillations are undesirable due to the above mentioned accelerated fatigue failure caused by cyclic movement.

The degree in which bending, and oscillations occur, however, is directly proportional to mass and inversely proportional to stiffness. The stiffening rib described below stabilizes the weight system of the golf club head to reduce club head bending for a reduction in oscillations and improved wear life in the club.

The term or phrase "integral" can be defined herein as two or more elements, if they are comprised of the same piece of material. As defined herein, two or more elements are "non-integral" if each element is comprised of a different piece of material.

The term or phrase "couple" "coupled", "couples", and "coupling" can be defined herein as connecting two or more elements, mechanically or otherwise. Coupling (whether mechanical or otherwise) may be for any length of time, e.g. permanent or semi-permanent or only for an instant. Mechanical coupling and the like should be broadly understood and include mechanical coupling of all types. The absence of the word "removably," "removable," and the like near the word "coupled," and the like does not mean that the coupling, in question is or is not removable.

The term or phrase "sole" can be defined as the bottom surface of the golf club head.

The term or phrase "attach", "attached", "attaches, and "attaching" can be defined herein as connecting or being joined to something. Attaching may be permanent or semi-permanent. Mechanically attaching and the like should be broadly understood and include all types of mechanical attachment means. Integral attachment means should be broadly understood and include all types of integral attachment means that permanently connects two or more objects together.

The restricted location and heavy mass of the weight system combine to allow for the center of gravity (CG) to be moved in toward the heel or toward the toe without also moving the CG forward. Golf club heads comprising the above structure, however, tend to reach fatigue failure at an accelerated rate when compared to golf club heads comprising a single material construction and a larger region for weight placement. Following impact with a golf ball, the body of the club head recoils. During recoil, the club head bends and deforms elastically at the location of the weight system. The restoration of the club to its original position causes the club head to oscillate near the weight system. In general, oscillations are undesirable due to the above mentioned accelerated fatigue failure caused by cyclic movement.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The term "ground plane" refers to a plane positioned at a 60 degree angle to a hosel axis of a golf club head with respect to a front view, and perpendicular to the hosel axis of the golf club head with respect a side view. The ground plane is tangent to a sole of the golf club head when the club head is at an address position. Further, the term "front plane" refers to a vertical plane that is tangential to a leading edge point when viewed from a side view, and also perpendicular to a ground plane.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

B. Golf Club Head

Described herein is a multi-material golf club head comprising at least one rib that stiffens the rear portion of the club head. The golf club head can comprise first component and a second component. The first component comprises a heavy weight system located at the rear of the club head. The weight system concentrates mass in a central rear potion of the club head to lower CG and increase MOI in the golf club head. The rib may be operative to reduce oscillations caused by the heavy weight system after impact. In some embodiments the rib may extend arcuately from the sole over the weight system. In other embodiments, the rib can extend from the weight system to the crown. In some embodiments, the rib has perforations for reducing the weight of the stiffening rib.

FIG. 1 illustrates a golf club head 100 according to an embodiment. The golf club head 100 includes a front portion 102 comprising a strikeface 118, a rear portion 104 opposite the front portion 102, a heel end 106, a toe end 108, a crown 110, and a sole 112. Together, the front portion 102, the rear portion 104, the heel end 106, the toe end 108, the crown 110, and the sole 112 together define a hollow structure with a plurality of interior surfaces therein. In the illustrated embodiments, the club head 100 is defined by a first component 120 and a second component 220 secured to together.

The various embodiments and examples of golf club head 100 described herein may have components and configurations that have dimensions, geometries, or orientations described according to reference points. Described in detail below are several of the reference indicators as shown in FIGS. 1-4.

Referring to FIG. 1, the strikeface 118 of the club head 100 comprises a geometric center 500. In some embodiments, the geometric center 500 can be located at the geometric centerpoint of the strikeface 118, and at a midpoint of a face height 504. In the same or other examples, the geometric center 500 can also be centered with respect to an engineered impact zone, which can be defined by a region of grooves on the strikeface 118. As another approach, the geometric center 500 of the strikeface 118 can be located in accordance with the definition of a golf governing body such as the United States Golf Association (USGA). For example, the geometric center 500 of the strikeface 118 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

Figure 2:
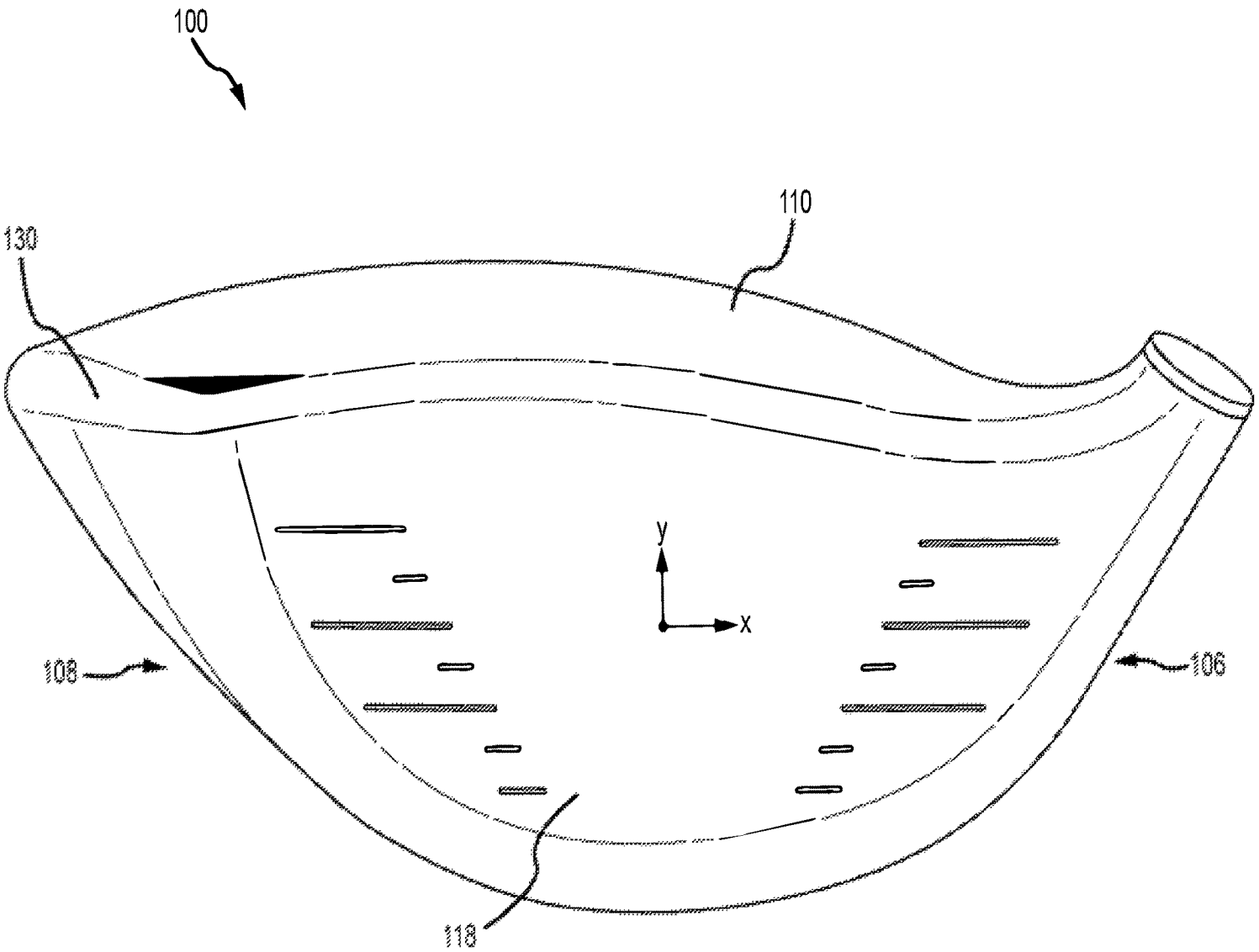
FIG. 2 illustrates a front view of the golf club head of FIG. 1.
Figure 3:
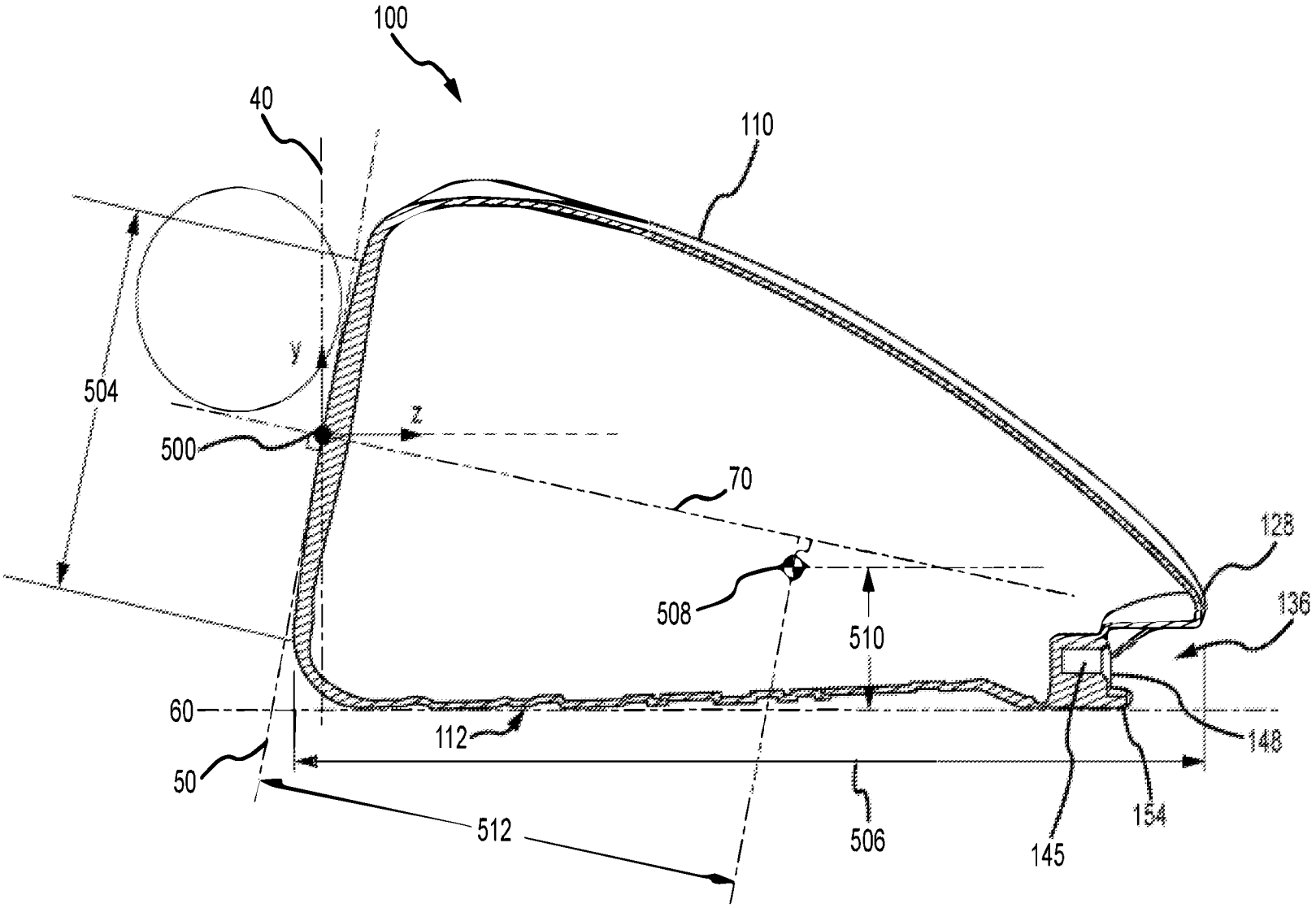
FIG. 3 illustrates a side cross sectional view of the golf club head of FIG. 1 taken at line 3-3 of FIG. 2.

Referring to FIG. 2-3, the golf club head 100 may comprise various reference planes and measurements. The golf club head 100 defines a front plane 40, a loft plane 50, and a ground plane 60. Further, the golf club head 100 comprises a coordinate system having an origin at the geometric center 500 of the strikeface 118. As shown in FIG. 2, the coordinate system can have an X axis 10, a Y axis 20, and a Z axis 30. When the golf club head 100 is at address, the X axis 10 extends through the strikeface geometric center 500 in a heel to toe direction and parallel to the ground plane 60. The Y axis 20 extends through the geometric center 500 from the crown 100 to the sole 112, and in a direction perpendicular to the X axis 10 and the ground plane 60. The Z axis 30 extends through the strikeface center 500 in a direction extending from the strikeface 118 to the rear end 104 of the golf club head 100. The Z axis 30 is perpendicular to the X axis 10 and the Y axis 20.

Referring to FIG. 2 the coordinate system defines a set of planes that also originate at the geometric center 500 of the strikeface 118. An XY plane is defined by the X axis and Y axis. In most embodiments, the XY plane is the front plane 40 (hereafter "front plane 40"). The loft plane 50 is positioned at an acute angle with respect to the front plane 40. The loft plane 50 is tangent to the strikeface 118. An XZ plane is defined by the X axis and Z axis. A YZ plane is defined by the Y axis and Z axis. Planes XY, XZ, and YZ are perpendicular to each other.

Referring to FIG. 3, the club head 100 further includes a length 506. The length 506 of the club head 100 can be determined according to the guidelines outlined by USGA. In general, the length 506 can be measured in a direction of the Z axis 30 as a greatest distance from the front plane 40 to the rear portion 104 of the club head 100. The height 504 of the club head 100 can be measured as the furthest extent of the club head from the crown 110 to the sole 112 in a direction parallel to the Y axis 20 when viewed normal to the front plane 40. Similarly, the golf club head height 504 can be measured according to guidelines outlined by USGA.

In these or other embodiments, the club head 100 can be viewed from a front view when the strikeface is viewed from a direction perpendicular to the XY plane. Further, in these or other embodiments, the club head 100 can be viewed from a side view or side cross-sectional view when the heel is viewed from a direction perpendicular to the YZ plane.

Referencing FIG. 3, club head 100 can further include a center of gravity (CG) 508. The position of CG can be described according to the loft plane 50, the ground plane 60, and a front plane 40. The CG 508 is positioned at a head CG height 510 and a head CG depth 512. The CG height 510 can be measured in a direction of the Y axis 20 from the ground plane 60 to the center of gravity 508. The CG depth 512 can be measured in a direction of the Z axis 10 from the front plane 40 to the center of gravity 508.

Figure 4:
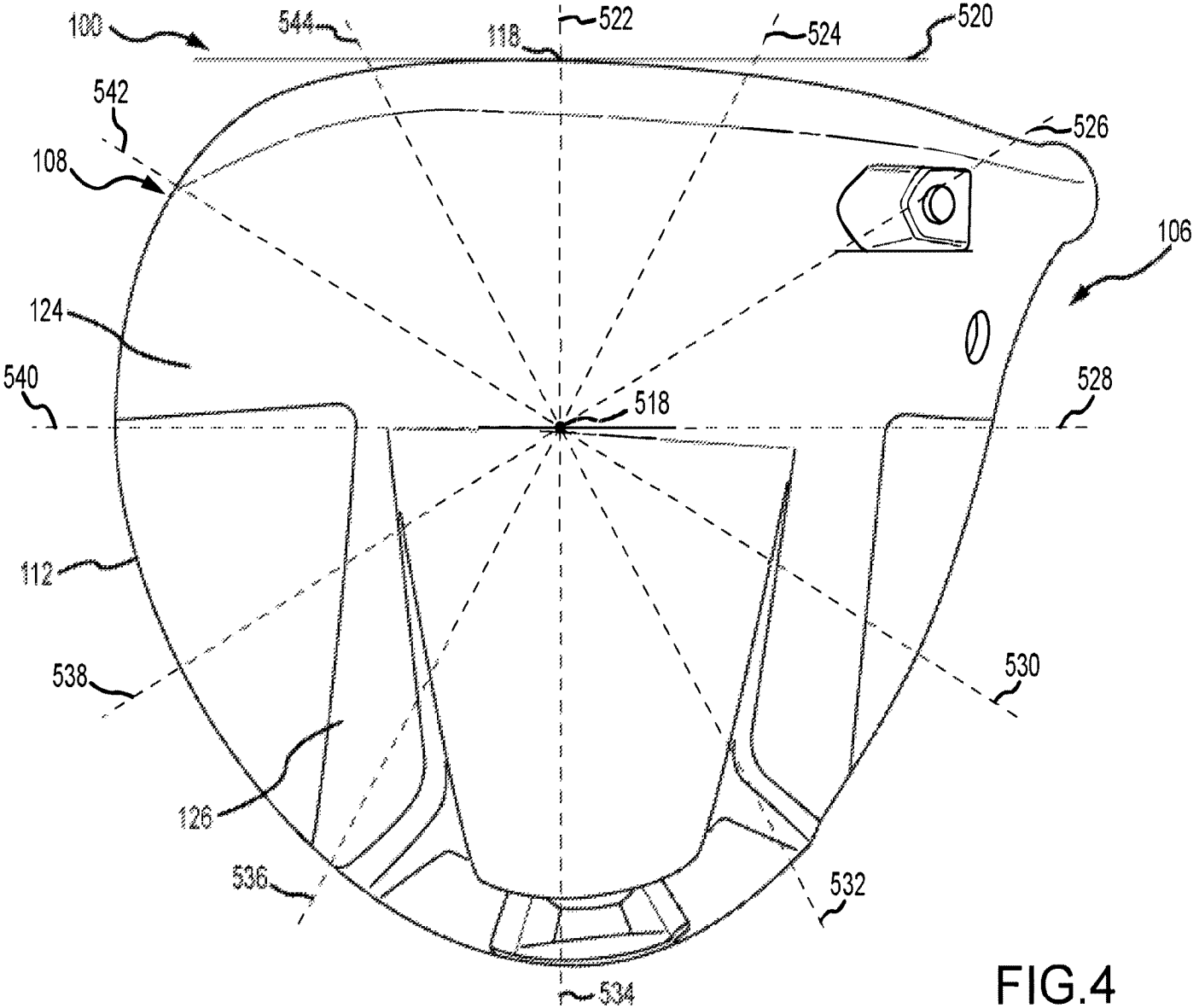
FIG. 4 illustrates a sole view of the golf club head of FIG. 1.

As shown in FIG. 4, the golf club head 100 can be described relative to a clock grid, which may be aligned with the strikeface 118 and projected from the ground plane 60 to the sole 112 of the club head 100. The clock grid can comprise 12 o'clock ray 522, which is aligned with the geometric center 500 of the strikeface 118 in the present embodiment. 12 o'clock ray 522 is orthogonal to a front intersection line 520, which is defined by the intersection of the loft plane 50 and the ground plane 60. The clock grid can be centered at a center point 518 along the 12 o'clock ray 522, at a midpoint between the front plane 40 and a rearmost end of the club head. In some examples, the clock grid center point 518 can be centered proximate to a geometric center-point 500 of the club head 100. The clock grid comprises a 3 o'clock ray 528 extending toward the heel end 106, a 9 o'clock ray 540 extending towards the toe end 108, and a 6 o'clock ray 534 extend toward the rear portion 104. The clock grid comprises a 4 o'clock ray 530 between the 3 o'clock ray 528 and the 6 o'clock ray 534, and a 8 o'clock ray 538 between the 9 o'clock ray 540 and the 6 o'clock ray 534. The clock grid further comprises a 5 o'clock ray 532 between the 4 o'clock ray 530 and the 6 o'clock ray 534, and a 7 o'clock ray 536 between the 8 o'clock ray 538 and the 6 o'clock ray 534. The clock grid further comprises a 1 o'clock ray 524, a 2 o'clock ray 526, a 10 o'clock ray 542, and a 11 o'clock ray 544.

In many embodiments, the club head 100 can be a driver or fairway wood type golf club head having a weight system 136, wherein a rib 300 is configured to stiffen the club head 100 in the location of the weight system 300. In many embodiments, the club head 100 can be a wood type golf club head (i.e. driver, fairway wood, hybrid).

In some embodiments, the club head 100 can comprise a driver. In these embodiments, the loft angle of the club head can be less than approximately 16 degrees, less than approximately 15 degrees, less than approximately 14 degrees, less than approximately 13 degrees, less than approximately 12 degrees, less than approximately 11 degrees, or less than approximately 10 degrees. Further, in these embodiments, the volume of the club head can be greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the club head can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

In some embodiments, the club head 100 can comprise a fairway wood. In these embodiments, the loft angle of the club head can be less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the club head can be between 12 degrees and 35 degrees, between 15 degrees and 35 degrees, between 20 degrees and 35 degrees, or between 12 degrees and 30 degrees.

In embodiments where the club head 100 comprises a fairway wood, the volume of the club head is less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In these embodiments, the volume of the club head can be approximately 160 cc-200 cc, approximately 160 cc-250 cc, approximately 160 cc-300 cc, approximately 160 cc-350 cc, approximately 160 cc-400 cc, approximately 300 cc-400 cc, approximately 325 cc-400 cc, approximately 350 cc-400 cc, approximately 250 cc-400 cc, approximately 250 cc-350 cc, or approximately 275 cc-375 cc.

In some embodiments, the club head 100 can comprise a hybrid. In these embodiments, the loft angle of the club head can be less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head 100 can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In embodiments where the club head 100 comprises a hybrid, the volume of the club head is less than approximately 200 cc, less than approximately 175 cc, less than approximately 160 cc, less than approximately 125 cc, less than approximately 100 cc, or less than approximately 75 cc. In some embodiments, the volume of the club head can be approximately 100 cc-160 cc, approximately 75 cc-160 cc, approximately 100 cc-125 cc, or approximately 75 cc-125 cc.

C. First and Second Golf Club Head Components

FIGS. 1-7 illustrate an embodiment of a multi-component golf club head 100 comprising structures that influence club head response to impact, such as a rib positioned within the interior of the hollow club head at the rear portion 104 and configured to stiffen the club head body and support a weight system 136. As later discussed, the golf club head 100 comprises at least one rib protruding from the interior surface of the weight system 136. The rib may be operative to reduce oscillations of the weight system 136 during and after impact. The structure of embodiments of golf club head 100 comprising this rib is described below in further detail. As discussed above, the golf club head 100 is a two component golf club head comprising a weight system 136 and a rib.

First Component

As discussed above, the golf club 100 head comprises a first component 120. The first component 120 comprises a first material as specified below. The first material can be a metal. Referencing FIGS. 5 and 6, the first component 120 can comprise the strikeface 118, a crown return 122, a sole return 124, a sole extension 126, and a back rail 128. The back rail 128 can further comprise a skirt portion 130 and the weight system 136. The crown return 122 can form a portion of the crown 110 adjacent the strikeface 118. The sole return 124, sole extension 126, and the back rail 128 can form a portion of the sole 112. Further, the sole return 124, sole extension 126, and the back rail define a perimeter edge of the first component 120. A first bond surface 180 can be created by thinning a portion of the first component 120 along the perimeter edge. From a sole view, the first component can be generally "T" shaped. The sole extension 126 and the back rail 128 form a vertical, stem portion of the "T" shape. The sole return 124 can form a horizontal, or top portion of the "T" shape.

The crown return 122 and sole return 124 extend rearward in a direction orthogonal to the strikeface 118. The sole extension 126 is adjacent the sole return 124. The sole extension 126 extends rearward from the sole return 124. The back rail 128 abuts a rearmost edge of the sole extension 126. The sole return 124, the sole extension 126, and back rail 128 may be integral. In other embodiments, the sole extension 126 and the back rail 128 can be formed separately, and then attached or secured to the first component 120.

Figure 6:
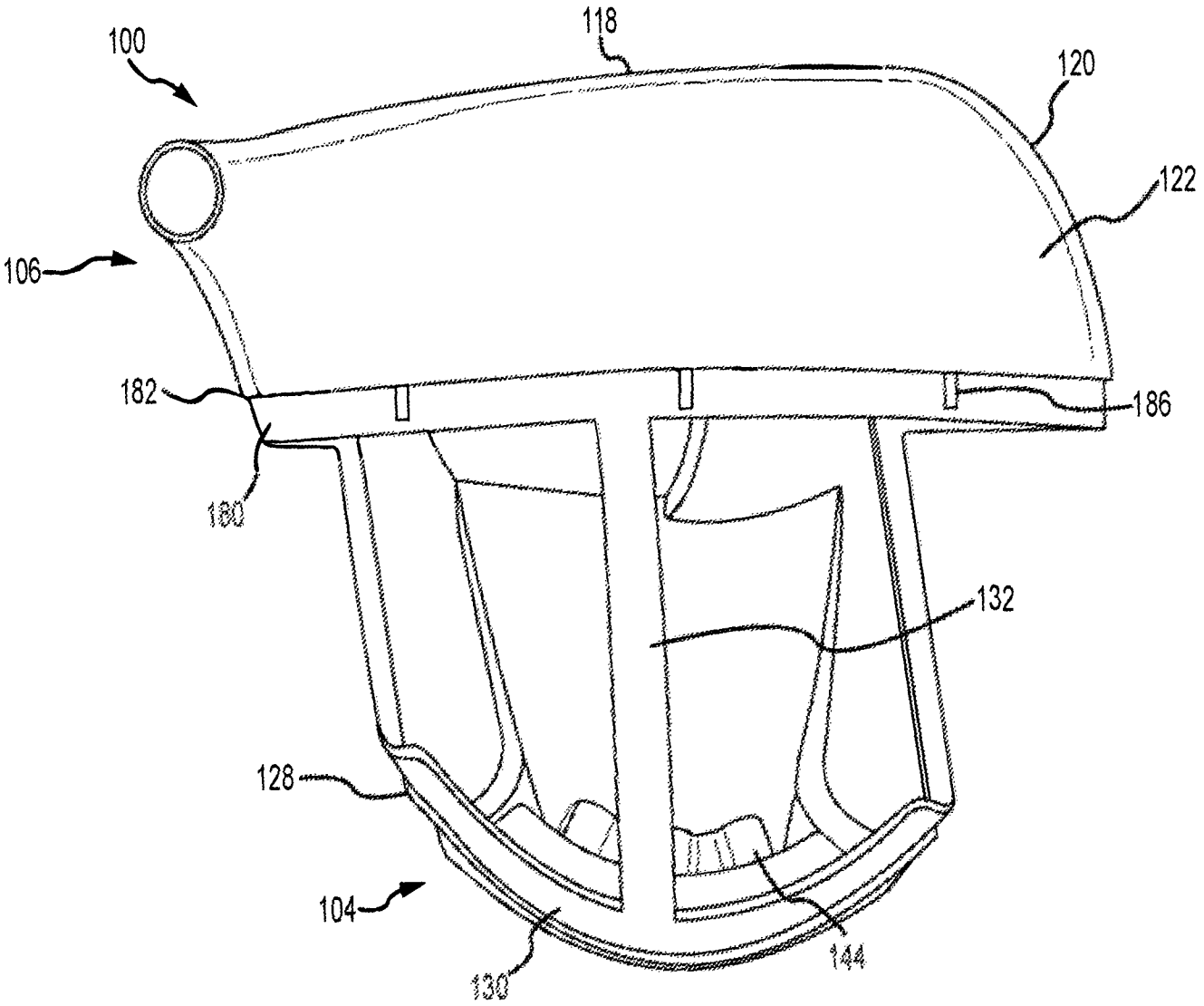
FIG. 6 illustrates a crown view of a first component of the golf club head of FIG. 1.

As shown in FIG. 6, in some embodiments, the first component 120 of golf club head 100 may further comprise a crown bridge 132. The crown bridge 132 may extend from the crown return 122 to the back rail 128 of the first component 120. In the illustrated embodiment, the crown bridge 132 extends from the crown return 122 to the back rail 128. The crown bridge 132 can serve to support the first component 120 during manufacturing. Additionally, the crown bridge 132 may serve as an attachment point for the above mentioned stiffening rib.

As shown in FIG. 6, the crown bridge 132 may further comprise a crown bridge width 134 measured in a heel to toe direction. The crown bridge width 134 can range from 0.25 inch to 2.0 inches. For example, the crown bridge width 134 can be between 0.25 inch to 0.50 inch, 0.50 inch to 0.75 inch, 0.75 inch to 1.0 inch, 1.0 inch to 1.25 inches, 1.25 inches to 1.50 inches, 1.50 inches to 1.75, 1.75 inches to 2.0 inches.

Further, the crown bridge may be located relative to the ZY plane 70. The crown bridge 132 can be offset from the ZY plane 70. For example, in the illustrated embodiment of FIG. 6, the crown bridge 132 is positioned toward the heel end 106 of the golf club 100 in reference to the ZY plane 70. In other embodiments, the crown bridge 132 can be positioned, closer to the toe end 108 of the golf club relative to the ZY plane 70. Alternatively, the crown bridge 132 can be located such that the crown bridge is aligned with the ZY plane 70. Furthermore, in other embodiments the crown bridge 132 can extend from the crown return 122 to the sole 124 return at an angle.

As previously mentioned, the first component 120 can comprise a first material, wherein the first material is metal. The first material comprises a first material mass that is associated with a first material density. Likewise, the second component 220 comprises a second material, wherein the second material is a composite. The second material comprises a material density that is less than the first material density.

The mass of the first component 120, as mentioned above, can be described as a percentage of an overall mass of the complete club head 100. The overall mass of the club head 100 can be the total mass of joined first 120 and second 220 components. The mass of the first component 120 can be 85%-96% of the mass of the complete club head 100. For example, the first component 120 can have a mass percentage of 85%, 86%, 87%, 88%, 89%, 90%, 91%, 92%, 93%, 94%, 95%, or 96%. Likewise, a mass percentage of the second component 220 can be 4% to 15% the mass of the complete club head 100. The first component 120 further comprises a weight system 136 located at the back rail 128 portion of the club head 100.

In some embodiments, the first component 120 can be manufactured as a single piece. In other embodiments, the first component 120 can be formed as multiple pieces that are connected or secured together, for example, through the use of adhesives, adhesive tapes, or mechanical fasteners. The first component 120 can comprise a metal material such as steel, tungsten, aluminum, titanium, vanadium chromium, cobalt, nickel, or other metals and metal alloys. In some embodiments the first component may comprise a titanium metal. In many embodiments, the first component 120 is made from a metallic material to withstand the repeated impact stress from striking a golf ball. In some embodiments, the first component 120 can be formed from stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In some embodiments, the strikeface 118 of the golf club head 100 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, an amorphous metal alloy, or a composite material.

In some embodiments, the first component 120 can be made of a single metal material. In other embodiments, the first component 120 can comprise multiple metal materials. For example, the strikeface 118, in some embodiments, may comprise a material that is different from the crown return 122, the sole return 124, the sole extension 126, and the back rail 128.

In many embodiments, the first component 120 can casted and formed as a single piece. In other embodiments, the first component 120, may be forged, pressed, rolled, extruded, machined, electroformed, 3D printed, or formed via any appropriated manufacturing technique. In many embodiments, the first component 120 can be manufactured to further comprise the stiffening rib for supporting the weight system 136 of the back rail 128.

Weight System

As noted above, the first component 120 comprises a large percentage of the overall club head mass. The first component 120 can comprise a weight system 136 that receives a moveable weight portion 140. The weight system 136 can be located in the back rail 128 of the first component 120. Referring back to FIG. 5, the back rail 128 of the first component comprises 120 the weight system 136 and is configured to localize mass the rearmost portion of the club. Localization of mass in the rear portion 104 of the club 100 can allow for the adjustment of the club head 100 mass properties, such as CG and MOI, according to player swing and impact characteristics. Ball flight can also be influenced by the position of the weight portion 140 within the weight system 136.

Figure 5:
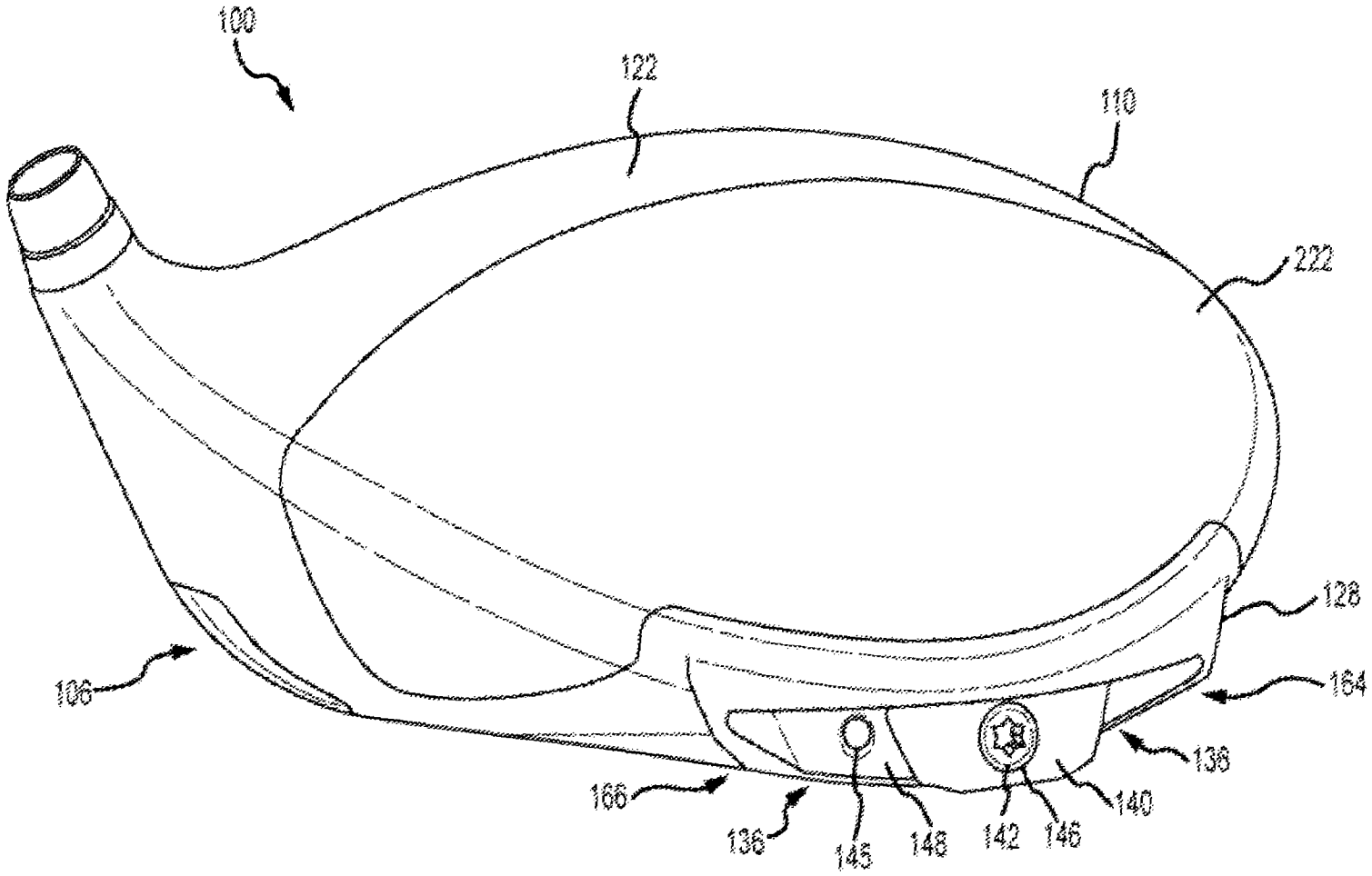
FIG. 5 illustrates a rear perspective view of the golf club head of FIG. 1.

Referring to FIGS. 4 and 5, the weight system 136 is located in the rear portion 104 of the club head 100 and within the back rail 128. The weight system 136 may further comprise the weight portion 140, a weight fastener 142, and at least one weight receiving boss 144. The weight receiving boss 144 can form an aperture 145 for receiving the weight fastener 142. The weight fastener 142 is configured to secure the weight portion 140 to the weight receiving boss 144.

The weight system 136 may further comprise a plurality of walls to house the weight portion 140 via the weight receiving boss 144 and weight fastener 142. Referring to FIG. 3, the walls may include a top wall 150 and a rear wall 152. Further the weight system can comprise a lip 154 protruding from the bottom of the rear wall 152. Together, the top wall 150, rear wall 152, and lip 154 define a weight channel 138. As shown in the cross section view of FIG. 2, the weight channel 132 is parallel to the ground plane and extends from the back rail 128 of the first component 120 and toward the front plane 40 in a rear to front direction.

Referring to FIGS. 3-5, the weight channel 138 comprises a channel surface 148 configured to house the weight portion 140. In most embodiments, the shape of the interior surface of the channel 138 is complementary to the shape of the weight portion 140. The top wall 150 of the weight channel 138 may be generally parallel to the ground plane 60 when the golf club head 100 is at address. The rear wall 152 of the weight channel 138 may be generally orthogonal to the ground plane 60 when the golf club head is at address. The lip 154 can protrude in the front to rear direction from the rear wall 152 nearest the ground plane 60. Further the top wall 150 and lip 154 may define a weight channel height 156 and a weight channel depth 158.

The weight channel height 156 can be measured as the vertical distance between the weight channel top wall 150 and the weight channel lip 154. The weight channel height 156 can range from 0.25 inch to 0.65 inch. In some embodiments, the channel height 156 can be approximately 0.25 inch, 0.26 inch, 0.27 inch, 0.28 inch, 0.29 inch, 0.30 inch, 0.31 inch, 0.32 inch, 0.33 inch, 0.34 inch, or 0.35 inch.

The weight channel depth 158 can be measured from as the distance from the rear most point of the back rail 128 to a juncture of the top wall 150 and rear wall 152. The channel depth 158 can range from 0.25 inch to 0.65 inch. In some embodiments, the channel depth 158 can be approximately 0.25 inch, 0.26 inch, 0.27 inch, 0.28 inch, 0.29 inch, 0.30 inch, 0.31 inch, 0.32 inch, 0.33 inch, 0.34 inch, or 0.35 inch.

Referring back to FIG. 4, the weight channel 138 may further comprise a weight channel length 162 measured between a weight channel heel end 166 and a weight channel toe end 166. The length of the channel 162 can have a range of 1.6 inches and 3.0 inches. In some embodiments the length of the channel may be 1.6 inches, 1.7 inches, 1.8 inches, 1.9 inches, or 2.0 inches, 2.1 inches, 2.2 inches, 2.3 inches, 2.4 inches, or 2.5 inches, 2.6 inches, 2.7 inches, 2.8 inches, 2.9 inches, or 3.0 inches. As mentioned above, the limited span of the weight channel can be operative for preventing movement of the club head CG 508 toward the strikeface 118.

In some embodiments, the location of the weight channel 138 may be described via a clock grid system mentioned above. Referencing FIG. 4, the weight channel 138 is located toward the rear portion 104 of the golf club head 100. Still referencing FIG. 4, the weight channel 138 can be located relative to hours on the clock. In some embodiments, as shown in FIG. 4, the weight channel toe end 164 and weight channel heel end 166 may be at least partially bounded by 4 o'clock ray and 8 o'clock ray. The location of the weight channel relative to the 4 o'clock and 8 o'clock rays confines the CG to the very rear of the club. Alternatively, the CG can be confined to the rear of the club by locating the weight channel between the 4 o'clock and 7 o'clock rays, the 5 o'clock and 8 o'clock rays, or the 5 o'clock and 7 o'clock rays.

As mentioned above, the weight system 136 may comprise a plurality of weight receiving bosses 144. In some embodiments, the weight system 136 may comprise two to six bosses 144 configured to receive the weight portion 140 via the weight fastener 142. In some embodiments, the weight system 136 may comprise 2, 3, 4, 5, or 6 bosses 144. In most embodiments, adjacent bosses 144 are equally spaced, however in some embodiments, adjacent bosses are unequally spaced. In one embodiment, the weight system 136 can comprise three bosses 144 spaced such that adjacent bosses 144 comprise a space ranging from 0.5 inch to 0.6 inch.

Referring to FIG. 4, weight portion 140 can be configured to be received and secured within the weight channel 138 via the weight receiving boss 144. The aperture 145 of the boss 144 may be internally threaded to selectively receive the weight fastener 146. The weight fastener 142 can comprise a length that is the same as or less than a length of the aperture 145. The weight portion 140 defines a through hole 146 in a center of the weight portion 140. The through hole 146 may further be dimensioned and configured to receive the weight fastener 142. In some embodiments, the through hole 146 of the weight portion 140 is at least partially threaded. Likewise, the weight fastener 142 may be threaded such that it is complementary to the threading of the through hole 146 and boss 144.

As illustrated in FIG. 5, the weight portion 140 can comprise a generally polygonal shape. The weight portion 140 can further comprise a weight portion mass. In some embodiments, the mass can range from 14 g to 50 g. For example, the detachable weight mass can be 14 g, 15 g, 16 g, 17 g, 18 g, 19 g, 20 g, 21 g, 22 g, 23 g, 24 g, 25 g, 26 g, 27 g, 28 g, 29 g, 30 g, 31 g, 32 g, 33 g, 34 g, 35 g, 36 g, 37 g, 38 g, 39 g, 40 g, 41 g, 42 g, 43 g, 44 g, 45 g, 46 g, 47 g, 48 g, 49 g, or 50 g. In some embodiments, the weight portion 140 may not comprise a mass less than 14 g. In embodiments of golf club heads comprising a weight portion having a mass above 13 g, the weight system 136 at the rear of the club head 100 can induce oscillations upon impact. In club heads lacking the herein described stiffening rib, the club head 100 may experience cyclic fatigue failure at an accelerated rate. The embodiments of the stiffening rib described below may reduce weight system 136 oscillations at the rear 104 of the club head 100 for increased durability.

As mentioned, the weight portion 140 of the weight system 136 is moveable between adjacent bosses 0.5 inch to 0.6 inch. Moving the weight portion 140 between bosses 144 may result in and overall movement of the club head CG 508. For example, when secured in the center boss, the CG 508 of the club head 100 is positioned to yield a straight golf shot. When secured in the heel boss, the CG 508 of the club head 100 is moved toward the heel to yield a fade type shot. The heel ward positioning results in a ball flight path that is generally left to right (for lefthanded golfers a right to left ball flight. Finally, when positioned in the toe boss, the CG of the clubhead is moved toward the toe to yield a draw type golf shot. The toe-ward positioning yields a ball flight that is generally right to left (for lefthanded golfers left to right).

Figure 7:
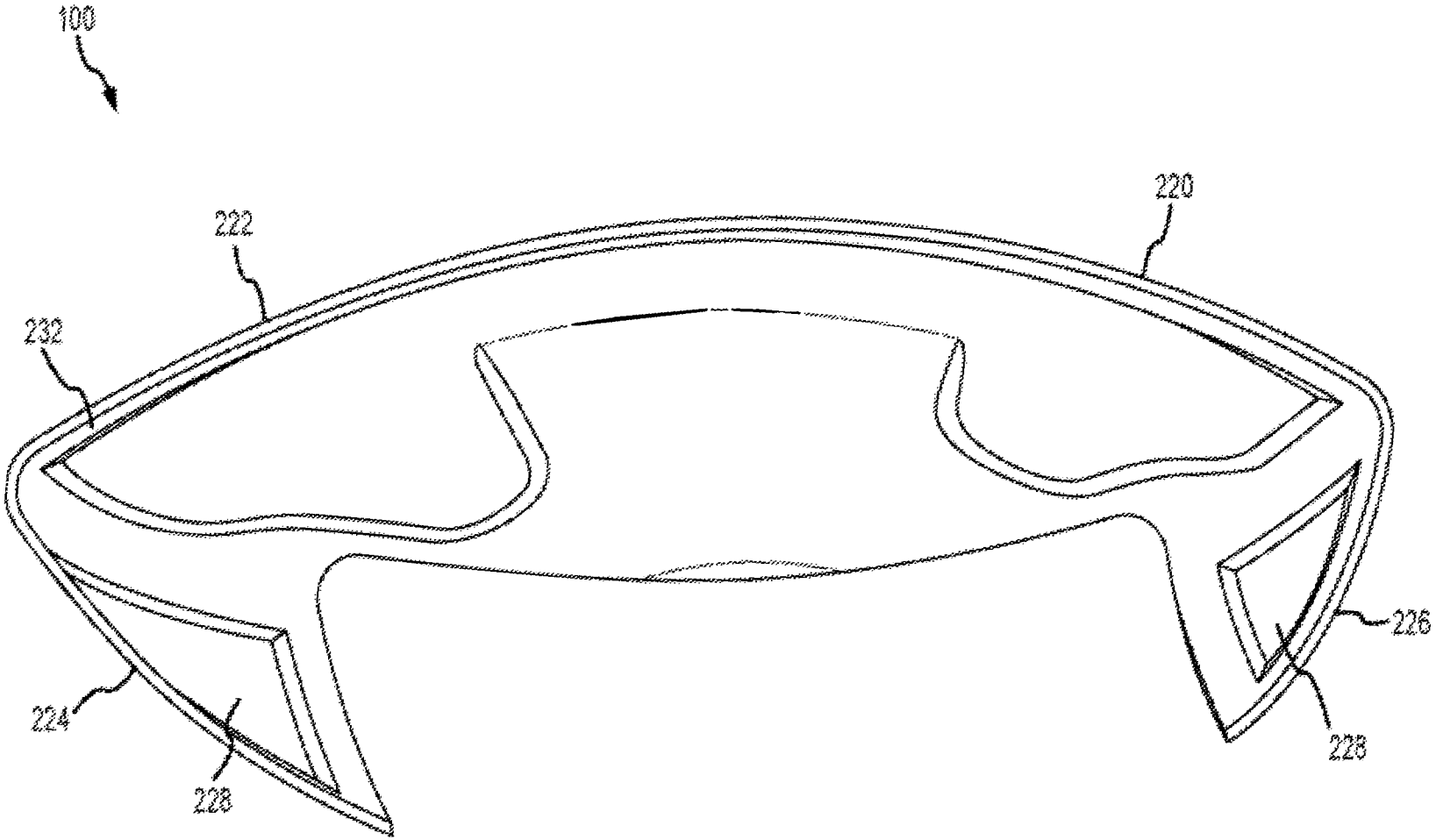
FIG. 7 illustrates a front perspective view of a second component of the golf club head of FIG. 1.

As illustrated in FIG. 7 the weight system may further comprise a base structure 170 for supporting the weight bosses 144 within the club head interior. The base structure 170 can protrude from an interior surface of the sole extension 126 to abut the weight channel rear wall 152 and be operative for weight channel sport. The weight receiving bosses 144 can be positioned within and/or on top of the base structure 170. In some embodiments, the bosses 144 and base structure 146 are integral.

The base structure may further include a front wall 172 and a top wall 174. In some embodiments, the front wall 172 is perpendicular to the top wall 174 to form a step-like geometry. The step like geometry of the base structure 170 can serve to rigidly secure the bosses 144 within the club head interior.

As described below, the golf club head can further comprise at least one stiffening rib. The at least one stiffening rib can attach to the base structure 170 described above. In some embodiments, the rib can also attach to one or more of the interior surfaces of the sole extension, weight channel top wall, the weight channel rear wall, the skirt, and the crown. The stiffening rib can rigidly fix interior surfaces of the club head to stiffen the club head body during impact. Attaching the stiffening rib to the weight system can prevent fatigue failure of the club head by dampening oscillatory motion of the weight system after impact.

Second Component

As discussed above, the golf club head 100 further comprises a second component 220. The second component 220 can comprise a composite material. The second component 220 attaches to the first component to define the hollow club head 100. Referencing FIG. 2, the second component can comprise a crown portion 222, a toe side wing 224, and a heel side wing 226. In some embodiments, the second component 220 can be configured to fit over the first component 120 to define the complete golf club head 100. In an assembled configuration, the second component 220 forms a majority of the crown 110 and a portion of the sole 112 at the heel end 106 and the toe end 108.

Figure 9:
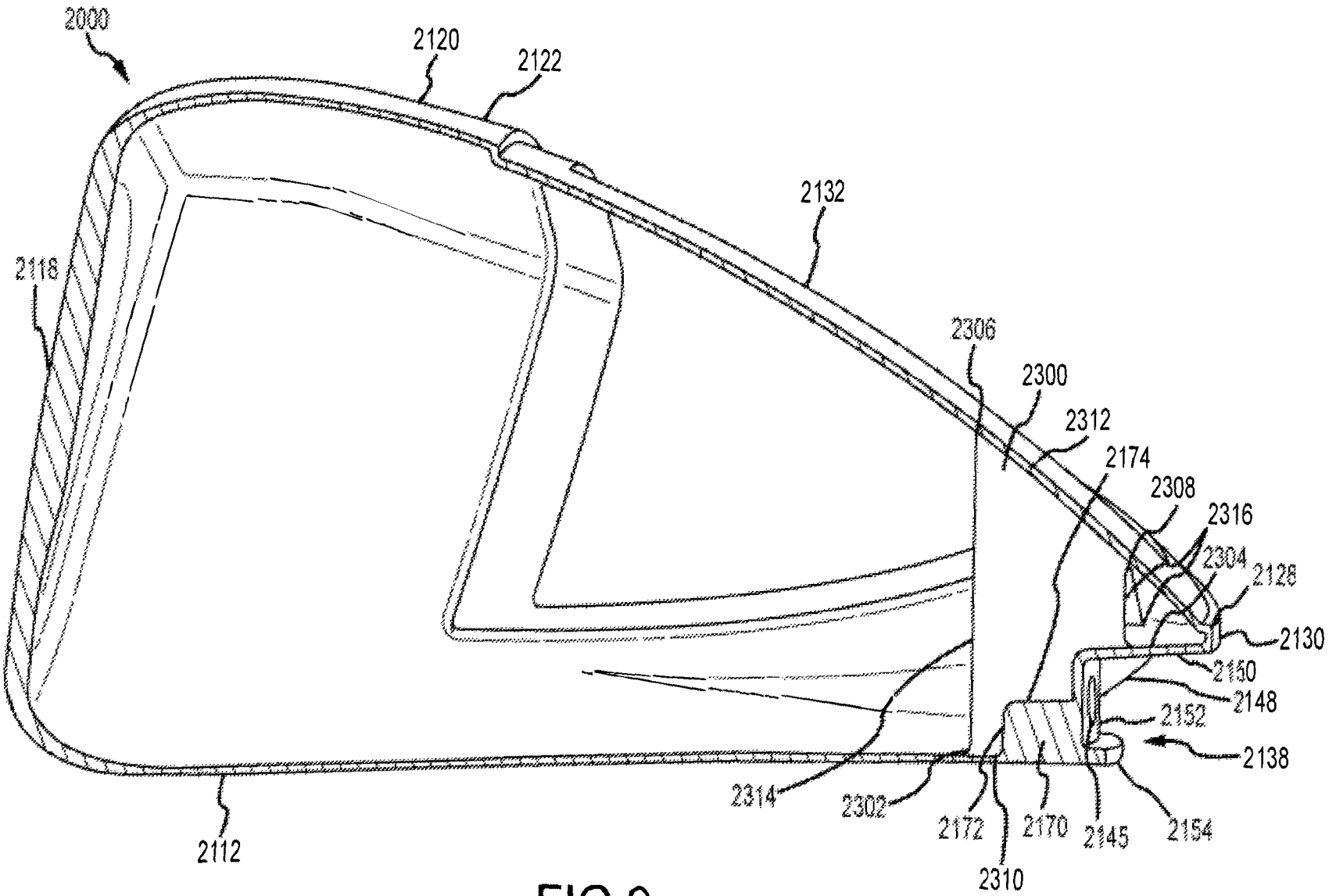
FIG. 9 illustrates a side cross sectional view of a rib configuration for a golf club head according to another embodiment.

Referencing FIG. 9, the toe side wing 224 and heel side wing 226 can comprise a generally triangular geometry. The toe side wing 224 may be configured to fit within the toe end crown return 122, sole extension 126 and back rail 128 of the first component 120. Likewise, the heel side wing 226 may be configured to fit within the heel end 106 of the crown return 122, sole extension 126, and back rail 128 of the first component 120. As mentioned, the second component 220 can comprise a second material that is less dense than the material of the first component 120. The second component 220 can be composite. The composite material of the second component 220 can be integrated with fillers such as fibers and beads for increased strength and durability. In other embodiments, the second component 220 can comprise any high strength plastic material integrated or co-molded with carbon/glass fibers, glass/metal beads, powders (e.g. tungsten powder), or any other fill material for increased strength, durability, or weighting.

In some embodiments, the second component 220 can comprise a composite formed from polymer resin and reinforcing fiber. The polymer resin can comprise a thermoset or a thermoplastic. More specifically, in embodiments with a thermoplastic resin, the resin can comprise a thermoplastic polyurethane (TPU) or a thermoplastic elastomer (TPE). For example, the resin can comprise polyphenylene sulfide (PPS), polyetheretheretherketone (PEEK), polyimides, polyamides such as PA6 or PA66, polyamide-imides, olyphenylene sulfides (PPS), polycarbonates, engineering polyurethanes, and/or other similar materials. The reinforcing fiber can comprise carbon fibers (or chopped carbon fibers), glass fibers (or chopped glass fibers), graphine fibers (or chopped graphite fibers), or any other suitable filler material. In other embodiments, the second component composite material can comprise beads (e.g. glass beads, metal beads) or powders (e.g., tungsten powder) for weighting. In other embodiments, the composite material may comprise any reinforcing filler that adds strength, durability, and/or weighting.

In some embodiments, the reinforcing fiber comprises a plurality of distributed discontinuous fibers (i.e. "chopped fibers"). In some embodiments, the reinforcing fiber comprises a plurality of discontinuous "long fibers," having a designed fiber length of from about 3 mm to 25 mm. For example, in some embodiments, the fiber length is about 12.7 mm (0.5 inch) prior to the molding process. In another embodiment, the reinforcing fiber comprises discontinuous "short fibers," having a designed fiber length of from about 0.01 mm to 3 mm. In either case (short or long fiber), it should be noted that the given lengths are the pre-mixed lengths, and due to breakage during the molding process, some fibers may actually be shorter than the described range in the final component. In some configurations, the discontinuous chopped fibers may be characterized by an aspect ratio (e.g., length/diameter of the fiber) of greater than about 10, or more preferably greater than about 50, and less than about 1500. Regardless of the specific type of discontinuous chopped fibers used, in certain configurations, the composite material may have a fiber length of from about 0.01 mm to about 25 mm.

The composite material may have a polymer resin content of from about 40% to about 90% by weight, or from about 55% to about 70% by weight. The composite material of the second component can have a fiber content between about 10% to about 60% by weight. In some embodiments, the composite material has a fiber content between about 20% to about 50% by weight, between 30% to 40% by weight. In some embodiments, the composite material has a fiber content of between about 10% and about 15%, between about 15% and about 20%, between about 20% and about 25%, between about 25% and about 30%, between about 30% and about 35%, between about 35% and about 40%, between about 40% and about 45%, between about 45% and about 50%, between about 50% and about 55%, or between about 55% and about 60% by weight.

The density of the composite material, which forms the second component, can range from about 1.15 g/cc to about 2.02 g/cc. In some embodiments, the composite material density ranges between about 1.30 g/cc and about 1.40 g/cc, or between about 1.40 g/cc to about 1.45 g/cc.

Recall, the second component can comprise a second component mass percentage of the overall mass of the golf club head. The mass percentage of the second component can range from 4% to 15% of the overall mass of the golf club head. For example, the mass percentage of the second component can be 4%, 5%, 6%, 7%, 8%, 9%, 10%, 11%, 12%, 13%, 14%, or 15%. The mass can range from approximately 10 grams to approximately 25 grams.

The second component of the golf club head can comprise a thickness. The thickness of the second component can be 0.008-0.065 inch. In some embodiments the thickness can have a range of 0.008-0.025 inch, 0.010-0.040 inch, 0.010-0.020 inch, 0.015-0.025 inch, 0.020-0.030 inch, 0.025-0.035 inch, 0.030-0.040 inch, 0.035-0.045 inch, 0.040-0.050 inch, 0.045-0.055 inch, 0.050-0.060 inch, or, 0.055-0.065 inch. For example, the thickness of the second component can be 0.008 inch, 0.010 inch, 0.015 inch, 0.020 inch, 0.025 inch, 0.030 inches, 0.035 inch, 0.040 inch, 0.045 inch, 0.050 inch, 0.055 inch, 0.060 inch, or 0.065 inch. The thickness of the second component can be constant or vary. For example, the second component thickness can vary within the crown portion, the toe side wing, the heel side wing, the rear end, and along the periphery of the second component.

As shown in FIG. 9, the second component may comprise a plurality of thinned sections. Each of the crown portion, heel side wing, and toe side wing of the second component can have one or more thinned section sections. In the illustrated embodiment, the thinned sections are centrally located in the crown portion, heel side wing, and toe side wing. In this embodiment, peripheral edges and a rear section of the crown portion are not thinned. The peripheral edge, or bonded surfaces, and crown region nearest the weight port maintain thickness due to inherently higher stress values. The thinned sections can reduce the overall mass of the second component allowing weight to be relocated to the weight system 136.

Connected First Component and Second Component

As discussed, the first component 120 and second component 220 define the complete golf club head 100. Referencing FIG. 6, the first component 120 may further comprise a first bond surface 180 or recessed lip, located along a peripheral edge of the first component 120 operative for joining the first and second components. The first bond surface 180 is configured to overlap with a portion of the second component 220 (a second bond surface 232) to form the complete club head 100.

The first bond surface 180 can be formed by thinning the perimeter edge of the crown return portion 122, sole extension 126, and back rail 128 of the first component 120 toward the club head interior. In other words, the first bond surface 180 can be recessed from an outer surface of the golf club head 100 to account for a combined thickness of the overlapping first bond surface 180 and second bond surface 232.

The first bond surface 180 can have a recess offset 182 from the outer surface of the club head 100 ranging from 0.060-0.160 inch. In other embodiments, the first component 120 can have a recess offset 182 of 0.060-0.150 inch, 0.060-0.140 inch, 0.080-0.160 inch, 0.090-0.150 inch, or 0.090-0.160 inch. For example, the recessed offset 182 can be 0.060 inch, 0.070 inch, 0.080 inch, 0.090 inch, 0.100 inch, 0.110 inch, 0.120 inch, 0.130 inch, 0.140 inch, 0.150 inch, or 0.160 inch.

As shown in FIG. 6, the width of the first bond surface 180 can have a range of 0.125-0.275 inch. In some embodiments the width of the first bond surface 180 can be 0.125 inch, 0.150 inch, 0.175 inch, 0.200 inch, 0.225 inch, or 0.275 inch.

The first bond surface 180 and second bond surface 132 may be secured via an epoxy or an adhesive formulated for bonding metal and composite materials. The adhesive can be (list adhesives). Further, the first bond surface 180 may comprise bond promoting features such as grooves or raised embossing. These features aid in even and controlled adhesive distribution over the first and second components during assembly.

II. Ribs

The golf club head can further comprise a rib having dimensional and positional characteristics that can determine club head performance as it relates to impact response for wear life of the club. The rib may be positioned within the interior surface of the club head body such that it stiffens the rear portion of the club head to reduce oscillations caused by the concentrated weight system after impact. As discussed below, the stiffening rib can dampen oscillations induced by the extreme concentration of mass in the rear portion of the club.

Following impact with a golf ball, the golf club head recoils. During recoil, the club head bends or deforms elastically, and then oscillates as a result of the conservation of momentum. In general, oscillations in a golf club head are undesirable due to cyclic fatigue to the club head body structure. The degree in which bending, and oscillations occur is directly proportional to mass, and inversely proportional to stiffness.

The weight system described above localizes mass to the back rail of the first component. Placing highly concentrated or localized mass in the rear of the club head necessitates additional stiffening of the rear portion of the club head. The stiffening rib of the herein described golf club head supports the weight system of the first component. A golf club head having a high rear mass, similar to the herein described golf club head 100, and lacking a stiffening rib would fail from cyclic fatigue at an accelerate rate. In particular, a multi-component golf club head lacking stiffening ribs would experience delamination at the lap joint between a first and second component of the club head. Furthermore, without the stiffening ribs to dampen oscillations of a high-mass weight system, the multi-material golf club head can experience material failure within a toe and heel wing of a composite component.

Stiffening the club head body over the location comprising the mass becomes necessary to prevent bending and oscillations at the junction of the weight support structure and the sole extension. It is understood mathematically that stiffening is most effective in the direction of force. The golf club head in the described embodiments generally experiences force in the front to rear and crown to sole direction during impact. Accordingly, referring to FIGS. 11-19, the stiffening rib extends in the front to rear direction, and comprises a height in the crown to sole direction to stiffen the rear portion of the club comprising the weight system.

Figure 8:
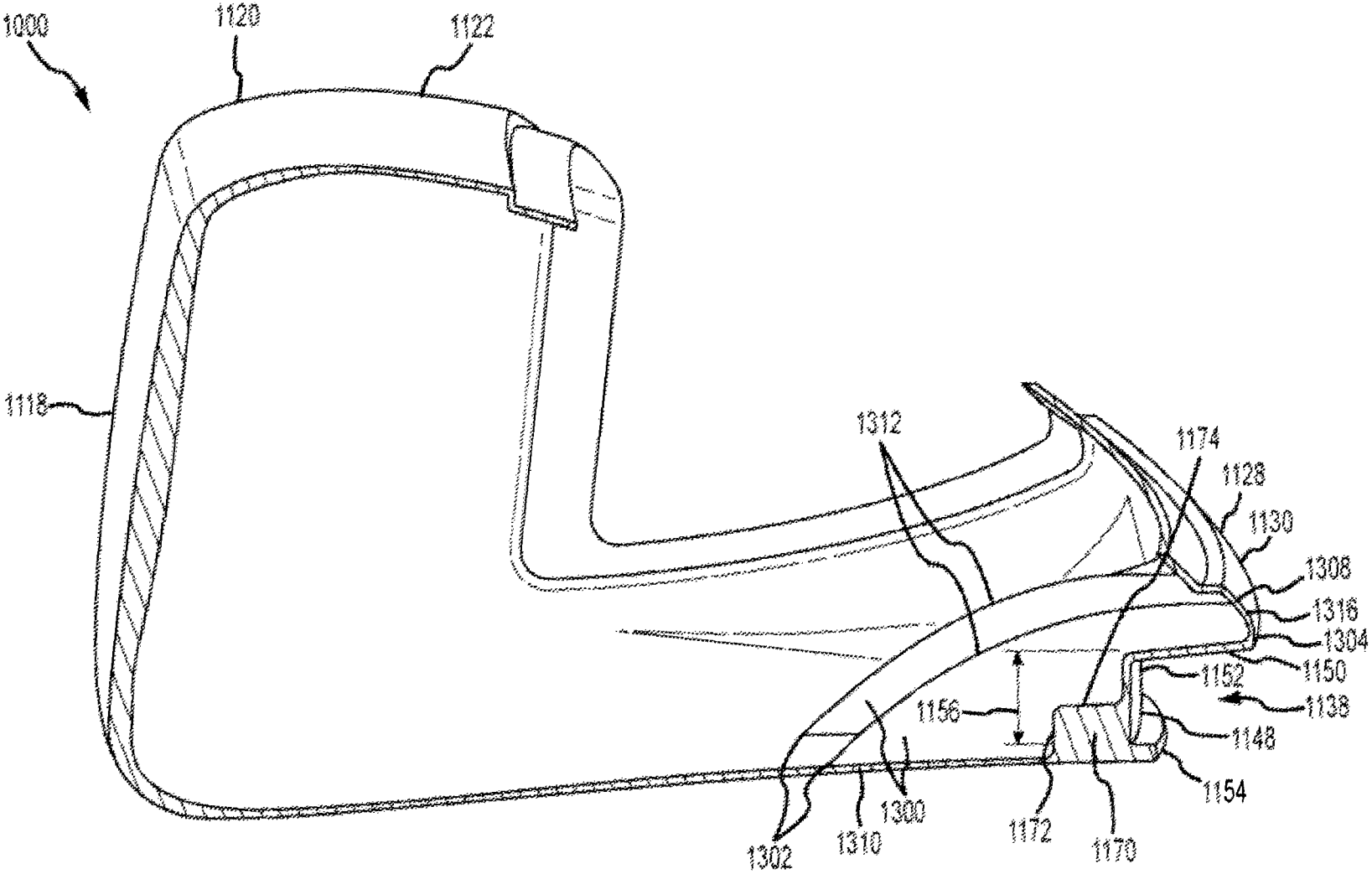
FIG. 8 illustrates a side cross sectional view of a rib configuration for a golf club head according to another embodiment.

The illustrated embodiments of FIG. 8-13 depict a generally planar rib extending in the front to rear direction. In some embodiments, such as those illustrate in FIGS. 9-13, the rib may further comprise a lower front end point, a lower rear end point, an upper front end point, an upper rear end point, a front edge, a rear edge opposite the front edge, a bottom edge, and a top edge opposite the bottom edge. The lower front end point is located toward the front plane on the sole interior surface. The lower rear end point is located opposite the front end point and proximal to the rear portion of the club. The front edge extends from the lower front end point to the upper front end point. The rear edge extends from the lower rear end point to the upper rear end point. The bottom edge extends from the lower front end point to the lower rear end point. The top edge extends from the upper front end point to the upper rear end point. In some embodiments, such as illustrated in FIG. 8, the rib lacks an upper front end point and a front edge. In these embodiments, the rib top edge extends from the lower front end point to the upper rear end point.

1. Dimensions

The stiffening rib can comprise a plurality of dimensions such as width, height, and thickness. Referencing the embodiments of FIG. 8-13, in some embodiments, the rib width can also be measured as the horizontal distance between opposing points along the front edge and rear edge of the rib. More specifically, the rib can comprise a maximum width measured as the horizontal distance between the lower front end point and lower rear end point.

In general, the ribs can have a width ranging from 0.25 inch to 2.50 inches. The rib width can between 0.25 inch and 0.50 inch, 0.50 inch and 0.75 inch, 0.75 inch and 1.0 inch, 1.0 inch and 1.25 inches, 1.25 inches and 1.50 inches, 1.50 inches and 1.75 inches, 1.75 inches and 2.0 inches, or 2.25 inches and 2.50 inches. In some embodiments, the rib width is constant in the vertical crown to sole direction, and in some embodiments the rib width varies in the vertical crown to sole direction.

In addition to width, the rib can further comprise the rib height dimension. The rib height can be measured from the interior surface of the sole extension to the top edge of the rib, in a direction perpendicular to the sole extension. In general, the ribs can comprise a maximum height range of 0.45 inch to 1.5 inches. In some embodiments, the ribs can comprise a maximum rib height between 0.45 inch and 0.75 inch, 0.75 inch to 1.0 inch, 1.0 inch to 1.25 inches, or 1.25 inches to 1.5 inches. In some embodiments, the maximum rib height is 0.48 inch or 1.03 inch. In some embodiments the rib height is constant over the rib width, and in some embodiments the rib height varies over rib width.

The ribs of the embodiments shown in FIGS. 8-13 may further comprise the rib thickness dimension, measured orthogonal to rib height and in a heel to toe direction. The embodiments illustrated in FIGS. 8-13 can comprise thickness values ranging from 0.0020 inch to 0.0075 inch. For example, the rib may have a thickness of 0.0020 inch to 0.0025 inch, 0.0025 inch to 0.0030 inch, 0.0030 inch to 0.0035 inch, 0.0035 inch to 0.0040 inch, 0.0040 inch to 0.0045 inch, 0.0045 inch to 0.0050 inch, 0.0050 inch to 0.0055 inch, 0.0055 inch to 0.0060 inch, 0.0060 inch to 0.0065 inch, 0.0065 inch to 0.0070 inch, or 0.0070 inch to 0.0075 inch.

2. Position

As explained above, in addition to dimensional characteristics, the degree in which the rib stiffens the rear portion of the club can be determined by the position of the rib. The position of the rib can be described relative to the front plane of the golf club head. In general, the ribs of the embodiments of FIGS. 8-13 are positioned within a rear 50% of the club head length. Specifically, in the illustrated embodiments, the lower front end point is located at a perpendicular distance from the front plane that is at least 50% of the club head length. In some embodiments, the rib is positioned within the rear 50%, 45%, 40%, 35%, 30%, 25%, 20%, 15%, 10%, or 5%.

As mentioned above, the stiffening ribs bottom edge attaches to the interior surface of the sole portion of the club. Additionally, the stiffening ribs can also extend over the base structure 170 of the weight system. In some embodiments, the stiffening ribs extend in between the weight receiving bosses 144. In these embodiments, the stiffening ribs do not intersect the weight receiving bosses 144. In some embodiments, placing the ribs between the adjacent weight receiving bosses 144 further stiffens the base structure 170 by supporting regions of the base structure 170 with less material.

3. Rib Attachment

In some embodiments, the one or more support ribs can be integrally formed with the first component. For example, the one or more support ribs can be investment cast, lost wax cast, centrifugally cast, or dye cast, to integrally form the one or more support ribs with the first component. The one or more integrally cast support ribs can comprise a planar geometry corresponding to the embodiments described below. The one or more integrally cast support ribs can be cast as such to join a portion of the base structure interior surface and a portion of the weight channel to the interior surfaces of the sole extension and skirt portion of the first component. Further, the one or more integrally cast support ribs can be cast to join the interior surface of the weight anchor and weight channel to at least one of the interior surfaces of the crown bridge and sole extension of the first component.

In some embodiments, the one or more support ribs can be formed separately from both the first component and the second component, and subsequently secured in position during assembly. In some embodiments, the one or more support ribs can be cut from a stock material (i.e., sheet metal, a rolled metal, a plastic, a polymer, stamped metal, etc.) via laser jet, water jet, stamping techniques, CNC machining, or any other suitable means of cutting one or more support ribs from a stock material. The one or more support ribs can be inserted into the interior of the golf club head via welding, laser welding, ultrasonic welding, electrical resistance welding, structural taping, adhesion, epoxy, co-molding, or any other suitable means of joining the one or more support ribs to the club head interior.

In other embodiments, the one or more support ribs can be formed via 3-D printing (stereolithography, fused deposition modeling, selective laser sintering, selective laser melting, electron beam melting, material jetting, or any other suitable 3-D printing technique), injection molding, forging, powder metal sintering, or any other suitable forming technique to independently create the one or more support ribs. The one or more support ribs can be inserted into the interior of the golf club head via welding, laser welding, ultrasonic welding, electrical resistance welding, structural taping, adhesion, epoxy, co-molding, or any other suitable means of joining the one or more support ribs to the club head interior.

In some cases, mechanical connections may also be implemented to permanently (or removably) join the one or more support ribs, to the interior surface of the golf club head. In these examples (not shown), the ribs are slidably secured along at least one of the bottom edge or top edge, via rib channels. The rib channels can be positioned on the interior surface of at least one of the first component or the second component. The one or more support ribs can be joined the at least one of the bottom edge or top edge, via any mechanical fixing technique such as studs, screws, posts, mechanical interference engagement, swedging, or any other suitable means of attaching the one or more support ribs.

In some embodiments, the first component or the first and second component comprise rib receiving channels for accepting and retaining the rib. Rib channels may be raised along the interior surface of the club head or be recessed within the interior surface of the club head. The channels can a comprise a channel length which corresponds to the width of the rib and a channel width which corresponds to the rib thickness.

Further, the channel can comprise a cross-sectional geometry that is orthogonal to the rib channel length. The cross sectional geometry can comprise any geometry capable of receiving and retaining the rib. For example, the rib channel can have, a U-shape geometry, a V-shape geometry, a C-shape geometry, a dovetail geometry, or any other geometry suitable for accepting the rib. Likewise, the top edge and bottom edge of the rib can comprise an edge geometry that corresponds to the cross sectional geometry of the rib channel. Other attaching means may be used in conjunction with mechanical connections. For example, the rib may be secured to the interior surface of the club with both the channel and an epoxy.

A. Arcuate Ribs

In some embodiments, a golf club head 1000 can comprise an arcuate rib 1300. The arcuate rib 1300 stiffens the rear portion of the club head body 1000 comprising a weight system 1136. In general, golf club head 1000 comprises is similar to golf club head 100. As illustrated, in FIG. 8, the arcuate rib 1300 comprises a curved profile. The arcuate rib 1300 extends vertically midway between the interior surface of the crown portion 1110 and the sole portion 1112.

Many of the features of the club head 1000, shown in FIG. 8, are similar to the features described above with respect to the club 100 in FIGS. 1-7. The similar features of the embodiment of FIG. 8 are referenced with similar reference numerals, using a series of "1xxx" reference numerals. Accordingly, some features may not be re-described or may be described with less detail below. Moreover, some features of club head 1000 may be described only with respect to the differences from club head 100. Therefore, certain drawings and figures may be unnecessary and duplicative of other drawings. Drawings that would be duplicative are not included.

Referencing FIG. 8, the golf club head 1000 comprises a first component 1120. The first component comprises a crown return 1122, a sole return 1124, a sole extension 1126, and a back rail 1128. The back rail 1128 further comprises a weight system 1136. The weight system further comprises a weight channel 1138 and a weight portion 1140 configured to be secured within the weight channel 1138. As above, the weight channel 1138 can be defined by a top wall 1150, a rear wall 1152, and bottom lip 1154. The weight portion 1140 is configured to be secured within the weight channel 1138 via a weight fastener 1142 and at least one weight receiving boss 1144. The club head interior 1000 further comprises a base structure 1170.

As mentioned above, and shown in FIG. 8, the golf club head 1000 further comprises the arcuate rib 1300. The arcuate rib can be defined and described by a plurality of end points, edges, and dimensions as defined above. The arcuate rib 1300 comprises a lower front end point 1302, and a lower rear end point 1304 opposite the lower front end point 1302. Further, the arcuate rib 1300 comprises a bottom edge 1310 adjacent the interior surface of a sole portion 1112, and a top edge 1314 opposite the bottom edge 1312. The arcuate rib 1300 may also comprise a rear edge 1316 and an upper rear end point 1308 above the lower rear end point 1304.

The arcuate rib 1300 embodiment comprises a rib width 1318, a rib height 1320, and a rib thickness 1322. The width 1318 of the arcuate rib 1300 can ranging from 0.5 inch to 2.50 inches. For example, the rib width can be approximately 0.5 inch to 1.0 inch, or 1.0 inch to 1.5 inches, or 1.5 inches to 2.0 inches, or 2.0 inches to 2.5 inches. In another embodiment, the rib width can be approximately 0.5 inch, approximately 1.0 inch, approximately 1.5 inches, approximately 2.0 inches, or approximately 2.5 inches.

The rib 1300 further comprises a rib height 1320 which can be measured in the manner outlined above. A maximum rib height can be measured as the greatest perpendicular distance between the sole extension 1126 and the top edge 1312 of rib 1300. The maximum height 1320 of arcuate rib 1300 can range from 0.40 inch to 0.60 inch. In some embodiments, the maximum height 1320 of the arcuate rib 1300 can range from 0.40 inch to 0.50 inch or 0.50 inch to 0.60 inch. In some embodiments, the maximum height 1320 of the arcuate rib 1300 can be 0.48 inch. As illustrated in FIG. 8, the rib height 1320 varies over the width 1318 to define the arcuate profile of rib 1300. The height 1320 of rib 1300 increases in a front to rear direction to create a curved shape.

The arcuate profile of rib 1300 may further described according to a radius of curvature 1324 along the top edge 1312. The radius of curvature 1324 can have a range of 1.0 inch to 4.0 inches. For example, the radius of curvature 1324 can range between 1.0 inch and 2.0 inches, 2.0 inches and 3.0 inches, or 3.0 inches and 4.0 inches. In some embodiments, the radius of curvature 1324 can be approximately 1.0 inch, 1.5 inch, 2.0 inch, 2.5 inch, 3.0 inch, 3.5 inch, or 4.0 inch. The radius of curvature 1324 and width 1318 are linked dimensions in rib 1300 such that as rib width 1318 increases, rib radius of curvature 1324 increases, and vice versa.

Continuing to reference FIG. 8, the arcuate rib 1300 protrudes from the interior surface of the sole extension 1126, the base structure 1170, and the interior surface of a top wall 1150 and rear wall 1152 of the weight channel 1138. As illustrated in FIG. 8, the arcuate rib 1300 extends in the front to rear direction such that the lower front end point 1302 is positioned within the rear 50% of the club head body 1000. FIG. 8 illustrates an embodiment wherein the rib 1300 is positioned in the rear 30% of the golf club head body 1000. In other embodiments the rib 1300 can be positioned in the rear 45%, 40%, 35%, 30%, 25%, 20%, 15%, 10% of the club head. For example, the rib 1300 can be positioned in the rear 5%, or 6%, or 7%, or 8%, or 9%, or 10%, or 11%, or 12%, or 13%, or 14%, or 15% the golf club head body 1000.

Further, the rib 1300 may extend such that the lower rear end point 1304 and rear edge 1316 abut a skirt portion 1130 of the club head body 1000 as shown in FIG. 8. In some embodiments (not shown), the lower rear end point 1304 and rear edge 1316 may not abut the skirt 1130. In these embodiments, the skirt 1130 and lower rear end point 1304 and rear edge 13116 may comprise a space therebetween.

B. Crown to Sole Rib

In some embodiments, such as the one illustrated in FIG. 9, a golf club head 2000 can comprise a crown to sole rib 2300. As illustrated, the rib 2300 extends between an interior surface of a sole 2112 to an interior surface of the crown 2110 to stiffen a rear portion 2104 of the club head body 2000. The rib 2300 can comprise a rectangular shape when viewed from a side cross-sectional view. As detailed above, the rib 2300 can reduce oscillatory motion of a localized weight system 2136 upon impact.

Many of the features of the club head shown in FIG. 9 are similar to the features described above with respect to the club 100 in FIGS. 1-7. The similar features of the embodiment of FIG. 9 are referenced with similar reference numerals using a series of "2xxx" reference numerals. Accordingly, some features may not be re-described or may be described with less detail below. Moreover, some features of club head 2000 may be described only with respect to the differences from club head 100. Therefore, certain drawings and figures may be unnecessary.

Referring to FIG. 9, the golf club head 2000 comprises the crown to sole rib 2300. As mentioned above, the rib 2300 can be defined and described by a plurality of end points, edges, and dimensions. The rib 2300 comprises a lower front end point 2302, and a lower rear end point 2304, opposite the lower front end point 2302. Further, the rib 2300 comprises an upper front end point 2306 and an upper rear end point 2308 above the lower rear end point 2304. The lower front end point 2302 and lower rear end point 2304 can define a bottom edge 2310. Likewise, a top edge 2312 of rib 2300 can be defined between the upper front end point 2306 and the upper rear end point 2308. Additionally, the above mentioned points can define a front edge 2314 and a rear edge 2316. The front edge 2314 can be defined between the lower front end point 2302 and upper front end point 2306. The rear edge 2316 of rib 2300 can be defined between the lower rear end point 2304 and upper rear end point 2308. The front edge 2314 and the rear edge 2316 can be straight and roughly vertical when the club head 2000 is at address.

Continuing to refer to FIG. 9, the rib 2300 comprises a width 2318, a height 2320, and a thickness 2322. The width 2318 of the rib 2300 can be measured as described above wherein width is measured as a horizontal distance between opposite points on the front edge 2314 and rear edge 2316 of the rib 2300. The width 2318 of rib 2300 can range from 0.25 inch to 0.75 inch. In some embodiments, the rib width 2318 can range from 0.25 inch to 0.35 inch, 0.35 inch to 0.45 inch, 0.45 inch to 0.55 inch, 0.55 inch to 0.65 inch, or 0.65 inch to 0.75 inch. In some embodiments, the rib 2300 comprises a width of 0.46 inch.

Further the rib 2300 comprises the rib height 2320. The rib height 2320 can be measured as the perpendicular distance from the sole extension 2126 to any point along the top edge 2312 of rib 2300. A maximum rib height can be above 0.75 inch, above 0.80 inch, above 0.85 inch, above 0.90 inch, above 0.95 inch, or above 1.0 inch. The thickness 2322 of the crown to sole rib 2300 can be measured orthogonal to rib height 2320 and in a heel to toe direction, and have can have the thickness values described above.

Referencing FIG. 9, the crown to sole rib 2300 can comprise a generally rectangular profile. The rib 2300, as shown, extends from the sole to the interior surface of the crown portion. Specifically, the bottom edge of the rib 2310 protrudes from the interior surface of the sole extension 2126, a base structure 2170, and a rear wall 2152 and top wall 2150 of a weight channel 2138. The top edge 2312 of the rib 2300 abuts the crown 2110. In some embodiments, the top edge 2312 can abut a crown bridge 2132 of the first component 2120. In some embodiments, the rib 2300 is integral with the first component 2120. In some embodiments, the club head 2300 can be devoid of the crown bridge 2132, such that the rib top edge 2312 abuts the composite second component 2220.

In some embodiments, the rib 2300 can be positioned such that the front edge 2314 of the rib and rear of the edge 2316 are free and do not abut an interior surface of the club head 2000. The lower rear end point 2304 of the rib 2300 can likewise be configured such that a skirt 2130 and lower rear end point 2304 comprise a space therebetween. In these embodiments, the rib 2300 can be positioned such that the width 2318 is contained within the rear 30% to 5% of the club head length.

C. Hourglass Crown to Sole Rib

Figure 10:
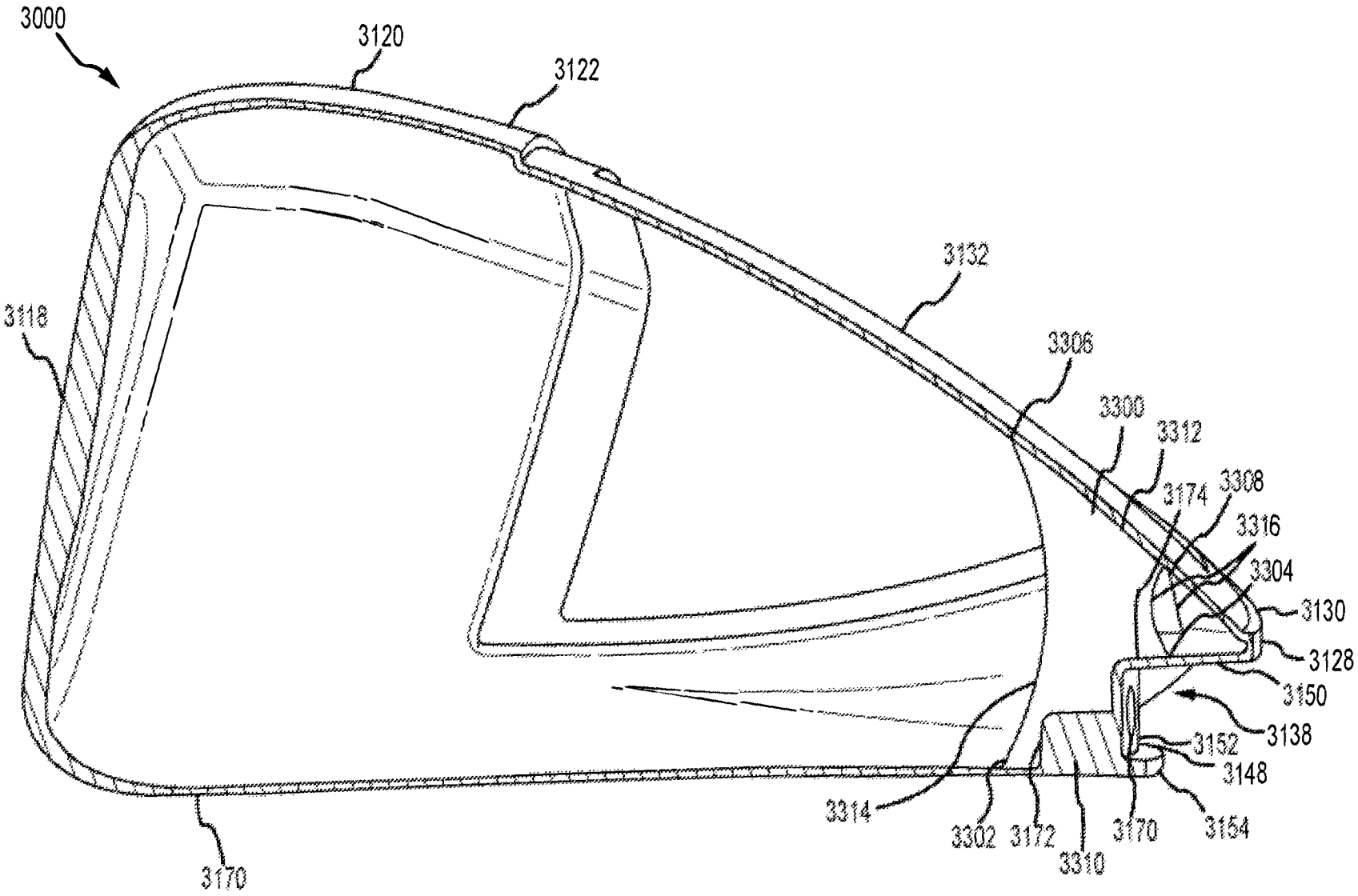
FIG. 10 illustrates a side cross sectional view of a rib configuration for a golf club head according to another embodiment.

In some embodiments, such as the one illustrated in FIG. 10, a golf club head 3000 can comprise an hourglass crown to sole rib 3300. The hourglass crown to sole rib 3300 can increase stiffness in the rear of the club while minimizing weight added by the inclusion of the rib 3300. As illustrated, the rib 3300 extends between an interior surface of a sole 3112 to an interior surface of the crown 3110 to stiffen a rear portion 3104 of the club head body 3000. The rib 3300 can comprise an hourglass shape when viewed from a side cross-sectional view. As described above, the rib 3300 can reduce oscillatory motion of a localized weight system 3136 upon impact.

Many of the features of the hourglass crown to sole rib 3300 shown in FIG. 10 are similar to the features of the crown to sole rib described above with respect to the club 2000 in FIG. 9 and the golf club head 100 in FIGS. 1-7. The similar features of the embodiment of FIG. 10 are referenced with similar reference numerals using a series of "3xxx" numerals. Similar features may not be re-described or may be described with less detail below. Moreover, some features of the rib 3300 may be described only with respect to the differences from the rib 2300.

In some embodiments, the golf club head 3000 can comprise the hourglass rib 3300. The rib 3300 comprises a lower front end point 3302, and a lower rear end point 3304, opposite the lower front end point 3302. Further, the rib 3300 comprises an upper front end point 3306 and an upper rear end point 3308 above the lower rear end point 3304. The lower front end point 3302 and lower rear end point 3304 can define a bottom edge 3310. Likewise, a top edge 3312 of rib 3300 can be defined between the upper front end point 3306 and the upper rear end point 3308. Additionally, the above mentioned points can define a front edge 3314 and a rear edge 3316. The front edge 3314 can be defined between the lower front end point 3302 and upper front end point 3306. The rear edge 3316 of rib 3300 can be defined between the lower rear end point 3304 and upper rear end point 3308. When observed from a front view of golf club head 3000, the front edge 3314 can comprise a curve that is generally concave. Further, when observed form the front view, the rear edge 3316 can comprise a curve that is generally convex.

Figure 11:
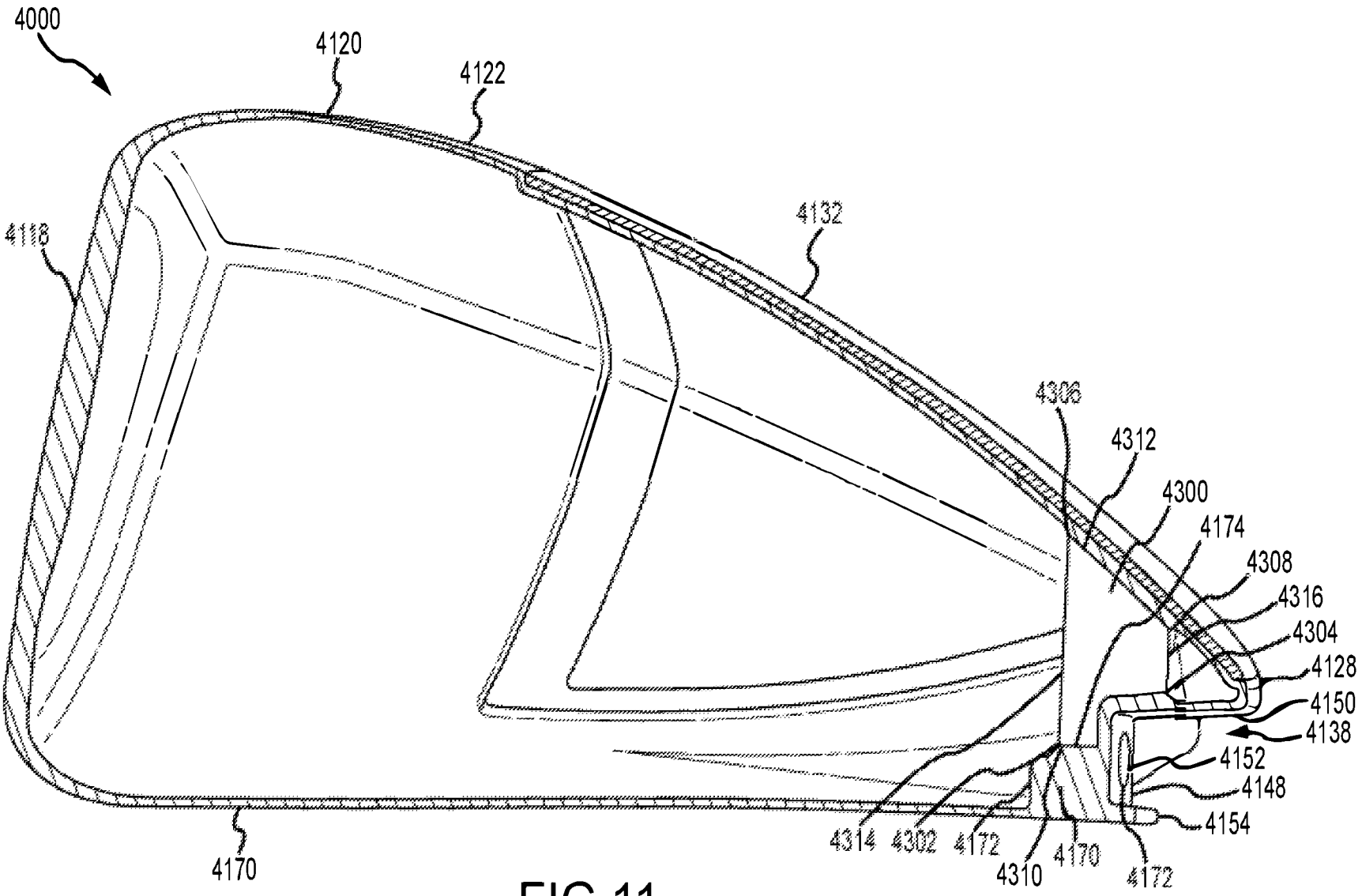
FIG. 11 illustrates a side cross sectional view of a rib configuration for a golf club head according to another embodiment.

The rib 3300 comprises a width 3318, a height 3320, and a thickness 3322. The width 3318 of the rib 3300 can be measured as described above wherein width is measured as a horizontal distance between opposite points on the front edge 3314 and rear edge 3316 of the rib 3300. When viewed from the side, as shown in FIG. 11, the rib 3300 of the club head 3000 comprises a substantially hourglass shape or hyperbolic shape. The hourglass shape can be formed by the width 3318, which varies over rib height 3320. In a sole to crown direction, the rib 3300 comprises a rib width 3318 that decreases from the sole 3112 to a midpoint between the crown 3110 and the sole 3112 and increases from the midpoint to the crown 3110. The variation of the rib width 3318 over height produces the tapered shape described as hourglass or hyperbolic in order to reduce the weight of the rib 3300.

In some embodiments, the varying width 3318 in the rib 3300 can reduce the weight of the rib 3300 when compared to a substantially similar rib having constant width. Minimizing the weight of the rib 3300 can provide stiffness without effecting the mass properties of the golf club head 3000. Weight reduction can vary depending on minimum width values and material properties.

Still referencing FIG. 10, the rib 3300, as shown, extends from the interior surface of the sole 3112 to the crown 3110. As shown, the bottom edge of the rib 3310 is adjacent to an interior surface of a sole extension 3126, a base structure 3170, and a rear wall 3152 and top wall 3150 of a weight channel 3138. The top edge 3312 of the rib 3300 abuts the crown 3110. In some embodiments, the top edge 3312 can abut a crown bridge 3132 of the first component 3120. In some embodiments, the rib 3300 is integral with the first component 3120. In some embodiments, the club head 3000 can be devoid of the crown bridge 3132, such that the rib top edge 2312 abuts the composite second component 3220.

In some embodiments, the rib 3300 can be positioned such that the front edge 3314 of the rib and rear of the edge 3316 are free and do not abut an interior surface of the club head 3000. The lower rear end point 3304 of the rib 3300 can likewise be configured such that a skirt 3130 and lower rear end point 3304 comprise a space therebetween. In these embodiments or other embodiments, the rib 3300 can be positioned such that the width 3318 is contained within the rear 30% to 5% of the club head length.

D. Base to Crown Rib

Moving to FIG. 11, a golf club head 4000 can comprise a base to crown rib 4300. As illustrated, the rib 4300 extends between a base structure 4170 located on an interior surface of a sole 4112 to an interior surface of the crown 4110 to stiffen a rear portion 4104 of the club head body 4000. In this embodiment, the rib 4300 joins the weight system 4136 directly to the crown 4110. The rib 4300 can comprise a rectangular shape when viewed from a side cross-sectional view. As described above, the rib 4300 can reduce oscillatory motion of a localized weight system 4136 upon impact by fixing the weight system 4136 directly to the crown 4110.

Many of the features of the base to crown rib 4300 shown in FIG. 11 are similar to the features of the rib described above with respect to the club 2000 and 3000 in FIGS. 9-10 and golf club head 100 in FIGS. 1-7. The similar features of the embodiment of FIG. 11 are referenced with similar reference numerals using a series of "4xxx" numerals. Similar features in golf club head 4000 may not be re-described or may be described with less detail below. Moreover, some features of the rib 4300 may be described only with respect to the differences from the rib 3300.

As above, the base to crown rib 4300 comprises a lower front end point 4302, and a lower rear end point 4304, opposite the lower front end point 4302. Further, the rib 4300 comprises an upper front end point 4306 and an upper rear end point 4308 above the lower rear end point 4304. The lower front end point 4302 and lower rear end point 4304 can define a bottom edge 4310. Likewise, a top edge 4312 of rib 4300 can be defined between the upper front end point 4306 and the upper rear end point 4308. Additionally, the above mentioned points can define a front edge 4314 and a rear edge 4316. The front edge 4314 can be defined between the lower front end point 4302 and upper front end point 4306. The rear edge 4316 of rib 4300 can be defined between the lower rear end point 4304 and upper rear end point 4308. When observed from a side cross sectional view, the front edge 4314 and the rear edge 4316 can be generally vertical when the club head 4000 is in an address position as shown in FIG. 11. In some embodiments, the rib 4300 can have a generally rectangular profile.

The rib 4300 comprises a width 4318, a height 4320, and a thickness 4322. The width 4318 of the rib 4300 can be measured in the manner described above between opposite points on the front edge 4314 and rear edge 4316 of the rib 4300. The rib 4300 may comprise ranges for height and thickness described in the embodiments above and in relation to golf club head 100.

The width 4318 of the rib 4300 can have a range of 0.20 inch to 1.0 inch. In some embodiments, the rib can have a width ranging from 0.20 inch to 0.30 inch, 0.30 inch to 0.40 inch, 0.40 inch to 0.50 inch, 0.50 inch to 0.60 inch, 0.60 inch to 0.70 inch, 0.70 inch to 0.80 inch, 0.80 inch to 0.90 inch, or 0.90 inch to 1.0 inch. In some embodiments, the rib width 4318 can be constant over the rib height 4320. FIG. 11 illustrates an embodiment of club head 4000 comprising a constant rib width 4318. In some embodiments, the rib width 4318 can vary over the rib height 4320. Varying the width 4318 of the rib 4300 can reduce the mass of the rib while maintaining structural integrity.

In some embodiments, the rib 4300 can protrude from the base structure 4170, and a rear wall 4152 and a top wall 4150 of a weight channel 4138. Further, the rib 4300 may be positioned, in some embodiments, to protrude from the base structure 4170 in between adjacent weight bosses 4144. The top edge 4312 of the rib 4300 can abut the crown 4110. In some embodiments, the top edge 4312 can abut a crown bridge 4132 of the first component 4120. In some embodiments, the rib 4300 is integral with the first component 4120. In some embodiments, the club head 4300 can be devoid of the crown bridge 4132, such that the rib top edge 4312 abuts a composite second component 4220.

In some embodiments, the rib 4300 can be positioned such that the front edge 4314 of the rib and rear of the edge 2316 are free and do not abut an interior surface of the club head 4000. The lower rear end point 4304 of the rib 4300 can also be configured to be spaced from a skirt portion 4130 of the club head 4000 as shown in FIG. 11. Further, the rib 4300 can be positioned such that the width 4318 is contained within the rear 30% to 5% of the club head length. For example, the rib 1300 can be positioned in the rear 5%, or 6%, or 7%, or 8%, or 9%, or 10%, or 11%, or 12%, or 13%, or 14%, or 15% the golf club head 4000.

E. Perforated Ribs

Figure 12:
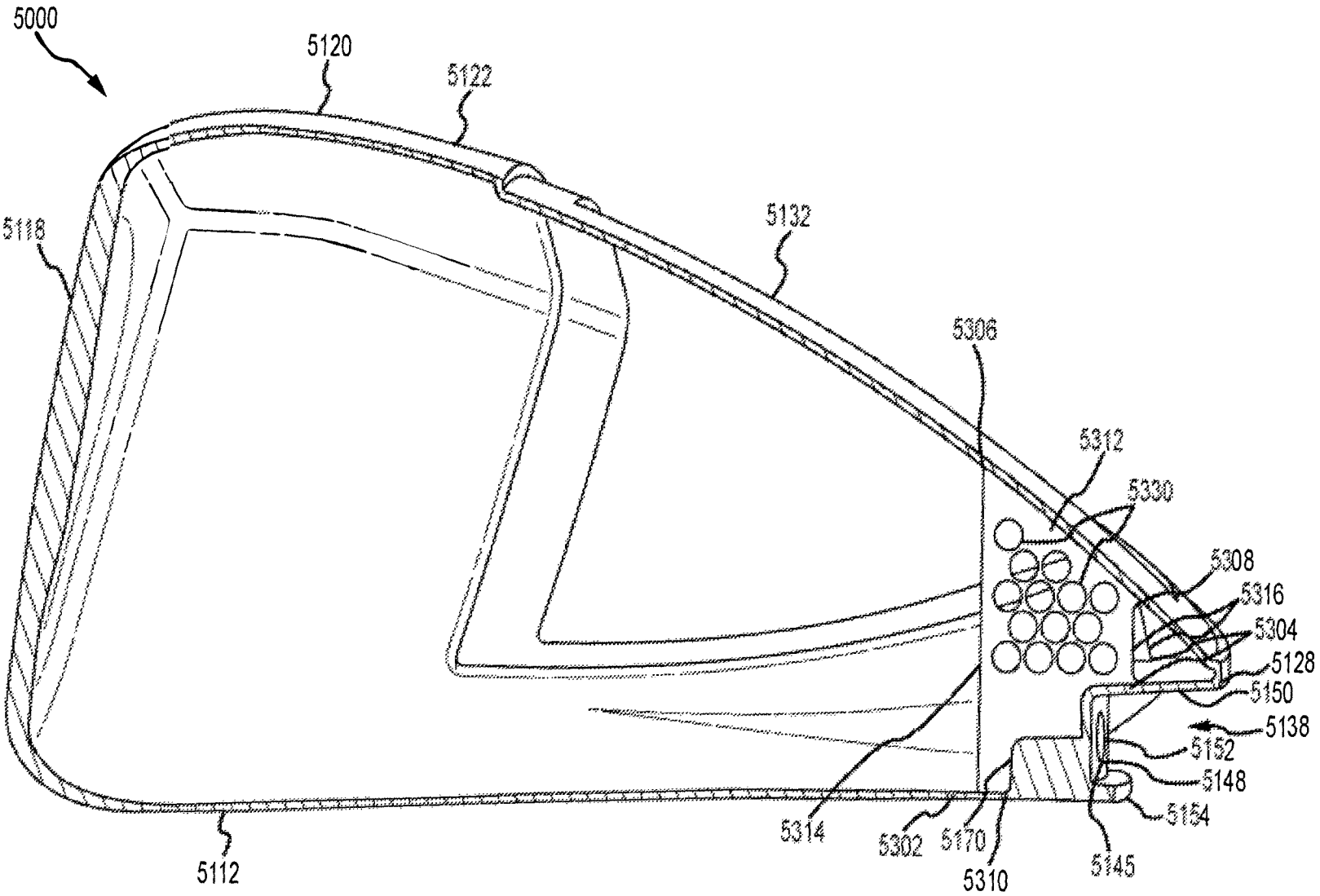
FIG. 12 illustrates a side cross sectional view of a rib configuration for a golf club head according to another embodiment.

Moving to FIG. 12 the multi-component golf club head 5000 can further comprise a perforated rib 5300 for stiffening the rear portion of the club head body 5000 while reducing mass. More specifically, the perforated rib 5300 can be configured to stabilize a weight system 5136 located in a back rail 5128. The perforated rib 5300 can stiffen the club head body 5000 in a weight efficient manner such that the addition of the rib 5300 does not influence the mass properties of the club head 5000.

Many of the features of the perforated rib 5300 shown in FIG. 12 are similar to the features of the rib described above with respect to the club heads 1000-4000 in FIGS. 8-11 and golf club head 100 in FIGS. 1-7. The similar features of the embodiment of FIG. 12 are referenced with similar reference numerals using a series of "5xxx" numerals. Similar features in golf club head 5000 may not be re-described or may be described with less detail below. Moreover, some features of the rib 5300 may be described only with respect to the differences from the rib 4300.

In this embodiment, the rib 5300 can define at least one perforation 5330, or aperture, through the substantially planar rib 5300. As shown in FIG. 12, perforations 5330 can be localized in the planar region of the rib 5300 above a base structure 5170.

Referring to FIG. 12, the perforated rib 5300 can comprises a lower front end point 5302, and a lower rear end point 5304, opposite the lower front end point 5302. Further, the rib 5300 comprises an upper front end point 5306 and an upper rear end point 5308 above the lower rear end point 5304. The lower front end point 5302 and lower rear end point 5304 can define a bottom edge 5310. Likewise, a top edge 5312 of rib 5300 can be defined between the upper front end point 5306 and the upper rear end point 5308. Additionally, the above mentioned points can define a front edge 5314 and a rear edge 5316. The front edge 5314 can be defined between the lower front end point 5302 and upper front end point 5306. The rear edge 5316 of rib 5300 can be defined between the lower rear end point 5304 and upper rear end point 4308. When observed from a side cross sectional view, the front edge 5314 and the rear edge 5316 can be generally vertical when the club head 5000 is in an address position as shown in FIG. 12. In some embodiments, the rib 5300 can have a generally rectangular profile.

The lower rear end point 5304 of the rib 5300 can be configured to be spaced from a skirt portion 5130 of the club head 5000 as shown in FIG. 12. Further, the rib 5300 can be positioned such that the width 5318 is contained within the rear 30% to 5% of the club head length. For example, the rib 5300 can be positioned in the rear 5%, or 6%, or 7%, or 8%, or 9%, or 10%, or 11%, or 12%, or 13%, or 14%, or 15% the golf club head 5000.

The as mentioned, the rib 5300 defines at least one perforation 5330. The perforations can provide weight savings for the rib 5300 as compared to a similar rib having a solid material construction. In some embodiments, weight saving scan be maximized by arranging the perforations 5330 according to nesting techniques. Nesting techniques can include positioning perforations 5330 with spacing to maximize weight savings while maintaining the structural integrity of the rib 5300. The embodiment of rib 5300 shown in FIG. 12 comprises perforations 5330 nested in a hexagonal fill pattern. In this arrangement, the rib 5300 can provide comparable structural integrity when compared to a solid rib comprising similar dimensions.

In the embodiment shown in FIG. 12, the perforated rib 5300 comprises a plurality of circular perforations 5330. As illustrated, the perforated rib 5300 comprises 14 circular perforations 5330 comprising a diameter of 0.010 inch. In some embodiments, the rib 5300 can comprise more or less perforations. Further, in some embodiments the at least one perforation 5330 can comprise a diameter that is greater than 0.010 inch. In some embodiments, the at least one perforation 5330 can comprise a diameter that is less than 0.010 inch.

In some embodiments, the perforated rib can have a profile having a rectangular shape as shown in FIG. 12. In other embodiments, the perforated rib 5300 can comprise a profile that is arcuate, as in FIG. 8, or hourglass, as in FIG. 10. In other embodiments, the rib 5300 may comprise any profile shape suitable for stiffening the club head 5000.

As above, the rib 5300 may have a width, a height, and a thickness dimensions associated with any of the above mentioned club heads and rib embodiments. Further, the rib 5300 can be positioned according to any of the above described golf club heads and rib embodiments.

F. Truss Rib

Figure 13:
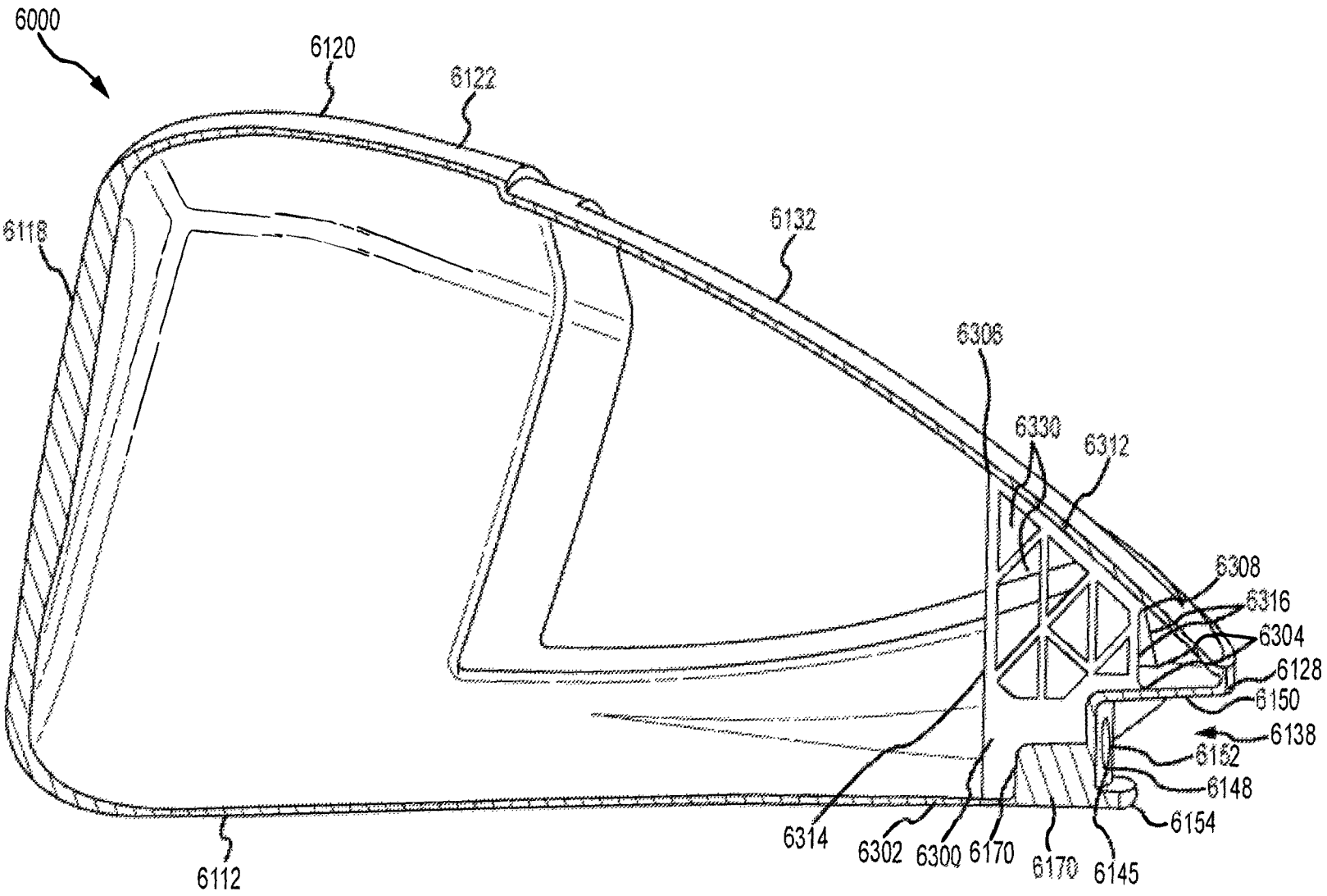
FIG. 13 illustrates a side cross sectional view of a rib configuration for a golf club head according to another embodiment.

The multi-component golf club head 6000, as shown in FIG. 13, can comprise a truss rib 6300 for stiffening the rear portion of the club head body 6000. More specifically, the truss 6300 can be configured to stabilize a weight system 6136 located in a back rail 6128. The truss rib 6300 can stiffen the club head body 6000 in a weight efficient manner such that the addition of the rib 6300 does not influence the mass properties of the club head 6000.

Many of the features of the truss rib 6300 shown in FIG. 13 are similar to the features of the rib described above with respect to the club heads 1000-5000 in FIGS. 8-12 and golf club head 100 in FIGS. 1-7. The similar features of the embodiment of FIG. 13 are referenced with similar reference numerals using a series of "6xxx" numerals. Similar features in golf club head 6000 may not be re-described or may be described with less detail below. Moreover, some features of the rib 6300 may be described only with respect to the differences from the rib 5300.

In this embodiment, the rib 6300 can comprise trussing. The trussing defines at least one aperture 6330 in the substantially planar rib 6300. The at least one aperture 6330 can comprise a polygonal geometry. For example, the at least one aperture can have a triangular shape, rectangular shape, or a polygonal shape. The polygonal aperture 6330 can comprise between 3 and 8 sides. In some embodiments, the rib 6300 can comprise a plurality of apertures 6330. In some embodiments, the apertures 6330 can comprise a substantially similar geometry. In some embodiments, the apertures 6330 can comprise differing geometry.

Referring to FIG. 13, trussing can be localized in the planar region of the rib 6300 above a base structure 6170. The perforated rib 6300 can comprises a lower front end point 6302, and a lower rear end point 5304, opposite the lower front end point 5302. Further, the rib 5300 comprises an upper front end point 6306 and an upper rear end point 6308 above the lower rear end point 6304. The lower front end point 6302 and lower rear end point 6304 can define a bottom edge 6310. Likewise, a top edge 6312 of rib 6300 can be defined between the upper front end point 6306 and the upper rear end point 6308. Additionally, the above mentioned points can define a front edge 6314 and a rear edge 6316. The front edge 6314 can be defined between the lower front end point 6302 and upper front end point 6306. The rear edge 6316 of rib 6300 can be defined between the lower rear end point 6304 and upper rear end point 6308. When observed from a side cross sectional view, the front edge 6314 and the rear edge 6316 can be generally vertical when the club head 6000 is in an address position as shown in FIG. 13. In some embodiments, the rib 6300 can have a generally rectangular profile.

The as mentioned, the rib 6300 comprises perforations 6330. The apertures 6330 can provide weight savings for the rib 6300 as compared to a similar rib having a solid material construction.

In some embodiments, the truss rib 6300 can have a profile having a rectangular shape as shown in FIG. 13. In other embodiments, the perforated rib 6300 can comprise a profile that is arcuate, as in FIG. 8, or hourglass, as in FIG. 10. In other embodiments, the rib 5300 may comprise any profile shape suitable for stiffening the club head 6000.

The lower rear end point 6304 of the rib 6300 can be configured to be spaced from a skirt portion 6130 of the club head 6000 as shown in FIG. 12. Further, the rib 6300 can be positioned such that the width 6318 is contained within the rear 30% to 5% of the club head length. For example, the rib 6300 can be positioned in the rear 5%, or 6%, or 7%, or 8%, or 9%, or 10%, or 11%, or 12%, or 13%, or 14%, or 15% the golf club head 6000.

EXAMPLES

As previously discussed, the dimensions and configurations of the support ribs detailed in the above embodiments effect the degree in which the weight system oscillates after impact. Low oscillations are desirable and are associated with a reduced level of material fatigue for longer club life. Weight portion oscillations can be reflected by measuring the velocity of the weight portion during and following impact. The velocity of the weight portion can be measured in isolation from the overall twisting and face deformation of the club head during a golf swing. To do so, the velocity of the weight portion is measured with respect to a reference plane. The reference plane is parallel to the loft plane and offset rearward from the loft plane by 1.0 inch. The reference plane was positioned where the club head experienced the least amount of overall twisting and translation during golf ball impacts. The positioning of the reference plane allowed for isolated measurement of the weight portion velocity relative to the structure of the club head. The reference plane defines a Y' axis that extends within the plane in a direction extending from the sole to the crown. The weight portion velocity was measured generally in the direction of a Y'axis.

The amplitude and velocity of the weight portion can be measured with respect to the Y' axis. Velocity measurements in the direction of the Y' axis indicate the weight portion's movement in time. Reduced magnitude and frequency values are desirable for increasing the durability of the club head.

In the examples below, weight portion velocity was recorded using finite element analysis (FEA). In each example, the golf club head comprises substantially similar constructions and weight portion configurations. The examples comprise separate and distinct rib configurations. The example golf club heads comprise a first component and a second component, similar to the golf club heads 100, 1000, 2000, 3000, 4000, 5000, and/or 6000 described above. Each example club head was compared to a control club head. The control club head was similar to the example club heads but devoid of a stiffening or support rib.

Figure 14:
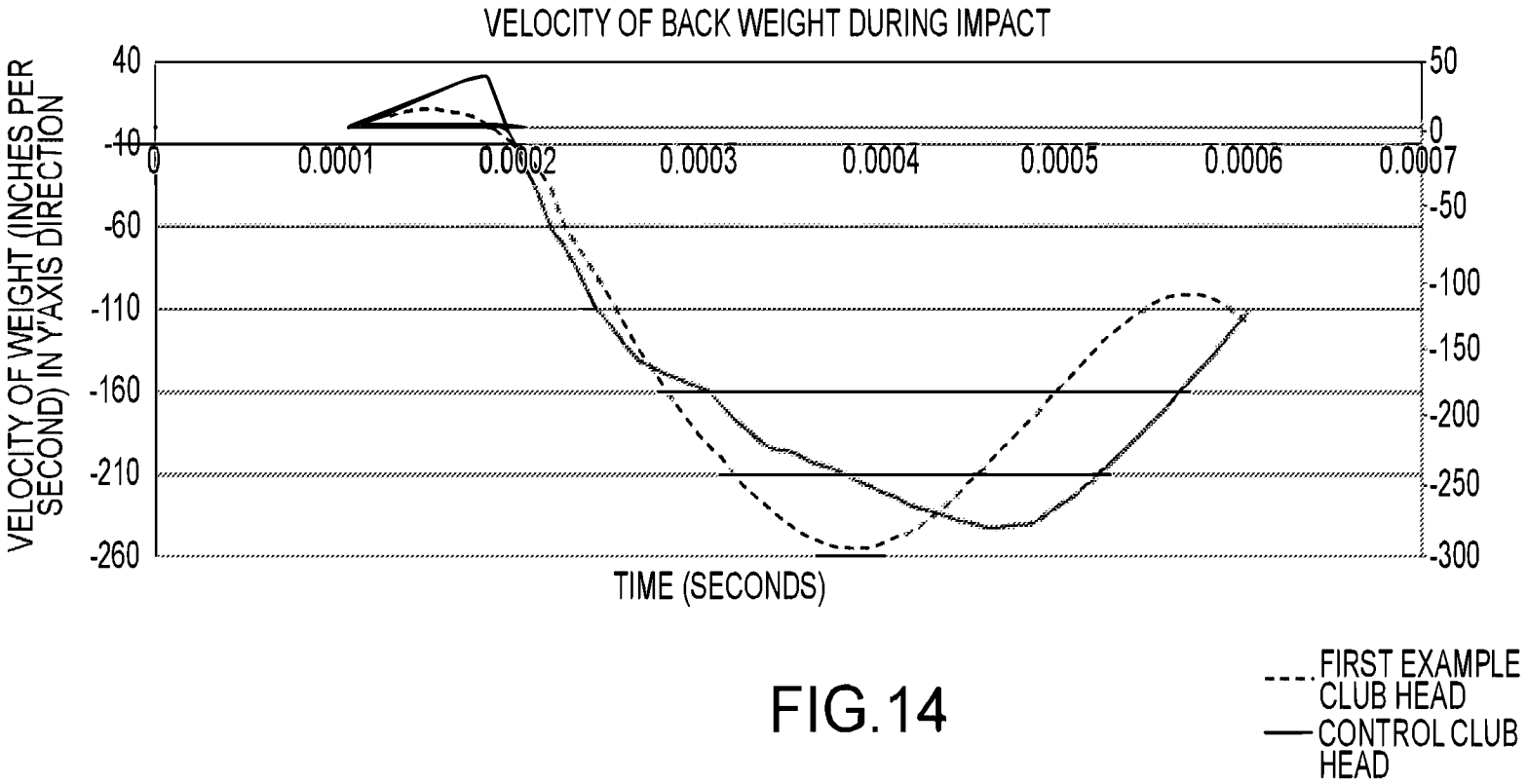
FIG. 14 illustrates a graph of weight portion velocity measured in inches per second vs. time measured in seconds for various rib embodiments described in this disclosure.
Figure 15:
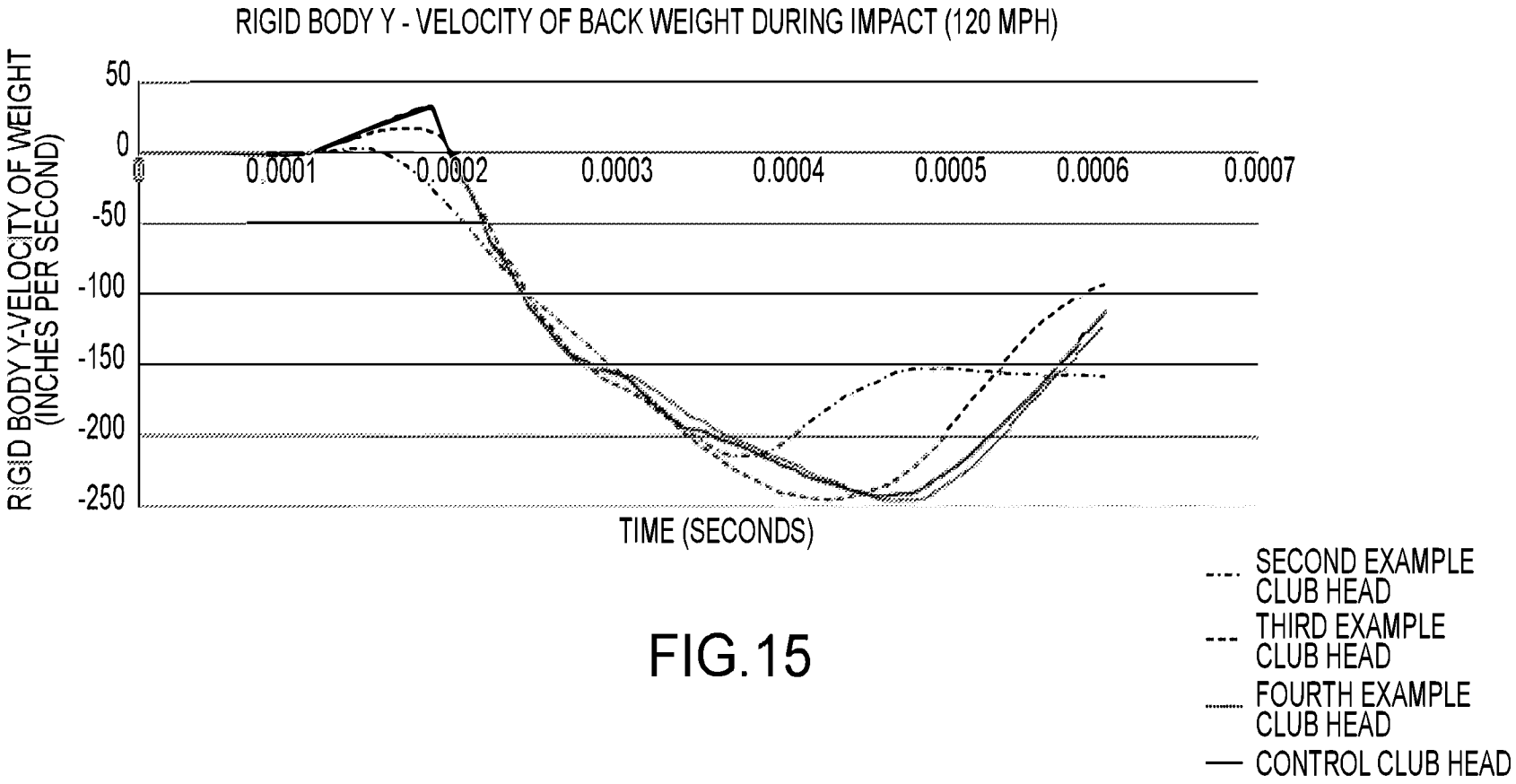
FIG. 15 illustrates a graph of weight portion velocity measured in inches per second vs. time measured in seconds for various rib embodiments described in this disclosure.
Figure 16:
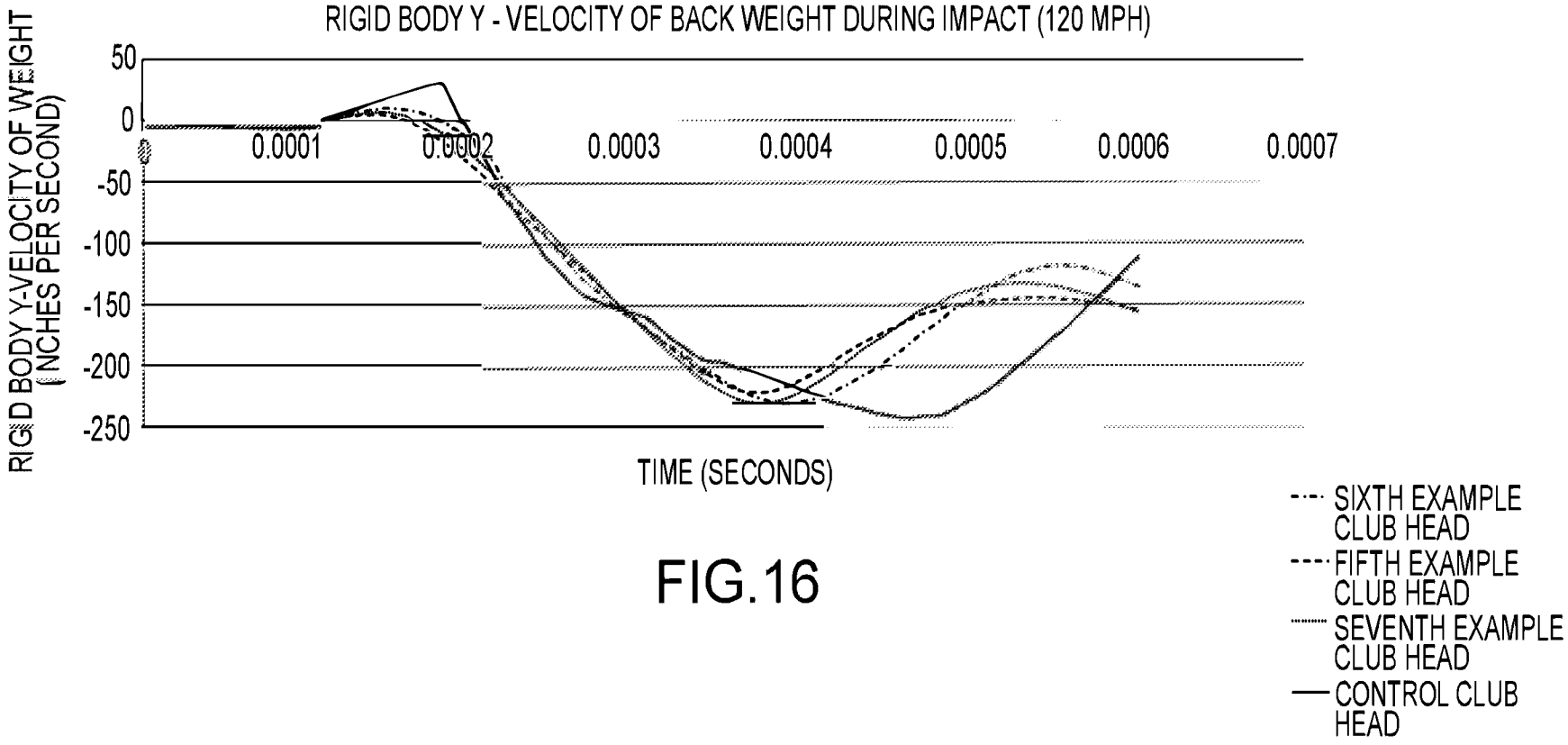
FIG. 16 illustrates a graph of weight portion velocity measured in inches per second vs. time measured in seconds for various rib embodiments described in this disclosure.

For each example, impact with a golf ball was simulated at 120 mph. The weight portion was fixed in the center boss and comprised a mass of 30 grams. As shown in FIGS. 14-16, the velocity of the weight portion center of mass was recorded along the Y' axis. The example club heads comprising a rib-supported weight structure, reduced the velocity of the weight portion from 45% to over 91% after impact compared to the control club head.

a. Example 1

The stability of the weight portion in a first club head was compared to the stability of the weight portion in the control club head upon impact with a golf ball. The first club head was similar to the club head 1000 described above and FIG. 8. The first club head comprised a first and second arcuate rib. The arcuate ribs extend from the interior surface at a front endpoint to a skirt portion of the first club head, similar to embodiment 1000. Both the first rib and the second rib join the following interior surfaces of the first metallic component of the first example head: the skirt portion, a top wall of the weight channel, a rear wall of the weight channel, a base structure that supports the boss extensions, and a sole extension.

The first rib protruded from the interior surface of the first component and was positioned between the heel boss and the center boss of the base structure. The second rib protruded from the interior surface of the first component and was positioned between the center boss and the toe boss of the plurality of receiving bosses. Further, the first rib comprised a width of 1.70 inches, a height of 0.48 inch, and a thickness of 0.0025 inch. The second rib comprised a width of 1.45 inch, a height of 0.48 inch, and a thickness of 0.0025 inch. The first and second ribs comprised a radius of curvature of 2.0 inches.

As illustrated in the graph of FIG. 14, an FEA analysis tracked the velocity of the weight portion, measured at the center of gravity of the weight portion, with respect to time in seconds after impact with a golf ball, for both the first club head and the control club head. The FEA analysis of the first club head resulted in a maximum weight portion velocity of roughly 10.2 inches per second. In the control club head, the weight portion velocity peaks abruptly at approximately 30.7 inches per second. In addition to the high velocity causing material fatigue, the abrupt peaking of the weight portion velocity can introduce stresses into the weight system that increase material fatigue and cause durability issues. The abrupt peaking of the weight portion velocity in the control club head is caused by the weight portion colliding with an upper wall of the weight channel.

When compared to the control club head, the velocity of the weight portion was reduced roughly 66%. Reducing the velocity of the weight portion (which corresponds to the oscillation of the rear of the club head) by 40% or greater prevents the club head from experiencing failure. As the velocity of the weight portion is reduced by a greater percent, the cyclic fatigue experienced by the club head is reduced, thereby increasing the durability of the club. Reducing the velocity of the weight portion limits the movement of the high mass weight system, thus preventing oscillations which, if undamped, could delaminate the second composite component from the first metal component. This example showed that the arcuate first and second ribs of the first club head created a rigid connection between the sole and weight system which reduced the oscillation of the weight portion after impact, increasing the durability of the club head.

b. Example 2

The stability of the weight portion in a second example club head was compared to the stability of the weight portion in the control club head upon impact with a golf ball. The second club head was similar to the club head 2000 described above and shown in FIG. 9. The second club head comprised a first metal component with a crown bridge and a constant width rib that extended from the sole extension to the crown bridge. The rectangular rib joined interior surfaces of the sole extension, the base structure, the weight channel top wall, the weight channel rear wall, and the crown bridge of the first metal component. The crown bridge comprised a crown bridge width of less than 0.75 inch. The maximum rib width was 0.46 inch. The rib thickness was 0.0025 inch.

Additionally, the rib was positioned such that it protruded from the surface of the base structure between the heel boss and the center boss. The rib was positioned in the rear 20% of the golf club head. The lower front end point of the rib along the interior surface of the sole portion was spaced more 4.0 inches from the front plane of the club head. Additionally, the lower rear end point of the rib was spaced from the skirt by 0.25 inch.

As illustrated in the graph of FIG. 15, an FEA analysis tracked the velocity of the weight portion, measured at the center of gravity of the weight portion, with respect to time in seconds after impact with a golf ball, for both the second club head and the control club head. The FEA analysis of the second club head resulted in a maximum weight portion velocity of roughly 3 inches per second after impact. The control club head performed as described above for Example 1. When compared to the maximum velocity of the weight portion in the control club head, the velocity of the weight port in the second club head was decreased by 85%.

As discussed for Example 1, reducing the velocity of the weight portion (which corresponds to the oscillation of the rear of the club head) by 40% or greater prevents the club head from experiencing failure. As the velocity of the weight portion is reduced by a greater percent, the cyclic fatigue experienced by the club head is reduced, thereby increasing the durability of the club. This example shows that the wide crown to sole rib of the second club head stiffens the rear of the club head significantly, such that the weight system can barely oscillate.

c. Example 3

The stability of the weight portion in a third club head was compared to the stability of the weight portion in the control club head upon impact with a golf ball. The third club head was similar to the club head 4000 described above and shown in FIG. 11. The third club head comprised a constant width crown to sole rib. The third club head rib joined to the interior surfaces of the base structure, the weight channel top wall, the weight channel rear wall, and the crown bridge.

The rib comprised a substantially rectangular profile, similar to the rib of the second example club head. However, the third club head rib comprised a reduced rib width, such that the rib did not meet the interior surface of the sole extension. In other words, the third club head rib was connected to the weight system but not connected directly to the sole extension. The rib width measured 0.26 inch. The rib thickness was 0.0025 inch.

Additionally, the rib was positioned such that it protruded from the surface of the base support between the heel boss and the center boss. The rib was positioned in the rear 15% of the golf club head. The lower front end point of the rib along the interior surface of the sole portion was spaced more 4.5 inches from the front plane of the club head. Additionally, the lower rear end point of the rib was spaced from the skirt by 0.25 inch.

As illustrated in the graph of FIG. 15, an FEA analysis tracked the velocity of the weight portion, measured at the center of gravity of the weight portion, with respect to time in seconds after impact with a golf ball, for both the third club head and the control club head. The FEA analysis of the third club head resulted in a maximum weight portion velocity of roughly 20 inches per second after impact. The control club head performed as described above for Example 1. When compared to the maximum velocity of the weight portion in the control club head, the velocity of the weight port in the third club head was decreased by 43%.

This example shows that a rib having a smaller width than the second example club head rib does not stiffen the club head to as great a degree. However, the smaller width rib of the third example club head still provides a significant benefit over the control club head. Furthermore, the smaller width rib of the third club head comprises less mass than the wider rib of the second club head. Therefore, the smaller width rib of the third golf club head provides stiffness and support to the weight system, while conserving desired mass properties.

d. Example 4

The stability of the weight portion in a fourth club head was compared to the stability of the weight portion in the control club head upon impact with a golf ball. The fourth club head comprised a substantially rectangular rib with a constant width.

The fourth club head stiffening rib was dimensionally similar to the rib of the third example club head. For instance, the rib width measured 0.26 inch, and the rib thickness was 0.0025 inch. However, in the fourth club head, the rib was positioned closer to the front plane of the golf club head. In particular, the rib was position forward of the base structure, such that no portion of the rib contacted any part of the weight system. In other words, the rib was decoupled, separate, or disconnected from the weight system. The rear end point of the rib along the interior surface of the sole extension was spaced 0.01 inch from the side wall of the base structure.

In the fourth club head, the rib was positioned in the rear 20% of the golf club head. The lower front end point of the rib along the interior surface of the sole portion was spaced more 4.0 inches from the front plane of the club head.

As illustrated in the graph of FIG. 15, an FEA analysis tracked the velocity of the weight portion, measured at the center of gravity of the weight portion, with respect to time in seconds after impact with a golf ball, for both the fourth club head and the control club head. The FEA analysis of the fourth club head resulted in a maximum weight portion velocity of roughly 34 inches per second. The control club head performed as described above for Example 1. When compared to the maximum velocity of the weight portion in the control club head, the velocity of the weight port in the fourth example club head was decreased by 3%.

The fourth golf club head performed substantially similarly to the control golf club. This example shows that when a club head comprises a rib decoupled from the weight system, the rib will have a minimal effect on preventing oscillation of the weight portion. Therefore, to effectively reduce the velocity of the weight portion, a supporting or stiffening rib must contact or engage at least a portion of the weight system. In particular, to effectively reduce weight portion oscillations, a rib must contact one or more of the base structure, the weight channel rear wall, and the weight channel top wall. By attaching the rib to the weight system, the stress experienced by the weight system can be transferred and dispersed into the rib. In embodiments where the rib spans from the sole over the weight system, the rib can prevent the weight channel rear wall and the weight channel top wall from buckling or hinging with respect to each other at impact.

e. Example 5

The stability of the weight portion in a fifth club head was compared to the stability of the weight portion in the control club head upon impact with a golf ball. The fifth club head was similar to the club head 3000 described above and shown in FIG. 10. The fifth club head comprised an hourglass crown to sole rib. More specifically, the golf club head comprised a first metal component and a second composite component wherein the first component comprised the crown bridge. The hourglass rib joined the interior surfaces of the sole extension, the base structure, the weight channel top wall, the weight channel rear wall, and the crown bridge.

In this fifth club head, the rib comprised an hourglass profile with a variable rib width. The rib width measured horizontally along the sole from the lower front end point to the lower rear end point was 0.46 inch. The rib width measured form horizontally along the crown from the upper front end point to the upper rear end point was 0.46 inch. The minimum rib width of between approximately 0.15 inch to 0.23 inch. The rib thickness was 0.0025 inch.

Further, the rib was positioned such that it protruded from the surface of the base structure between the heel boss and the center boss. The rib was also positioned in the rear 20% of the golf club head such that front end point of the rib at the interior surface of the sole portion was spaced more 4.5 inches from the front plane of the club head. Additionally, the rear end point of the rib was spaced 0.25 inch from the skirt.

As illustrated in the graph of FIG. 16, an FEA analysis tracked the velocity of the weight portion, measured at the center of gravity of the weight portion, with respect to time in seconds after impact with a golf ball, for both the fifth club head and the control club head. The FEA analysis of the fifth club head resulted in a maximum weight portion velocity of roughly 5 inches per second. The control club head performed as described above for Example 1. When compared to the maximum velocity of the weight portion in the control club head, the velocity of the weight port in the fifth club head was decreased by 85%.

The hourglass shaped rib of the fifth club head decreased the velocity of the weight portion by approximately the same percentage as the rectangular rib of the second club head, described above in Example 2. Since the hourglass rib comprises a smaller volume than the rectangular rib, the hourglass rib also comprises a smaller mass than the rectangular rib. Therefore, the hourglass shaped rib of the fifth club head prevents oscillation of the weight system without adding unnecessary structural mass to the club head. Additionally, the hourglass shaped rib provides the same surface area stiffness as the rectangular rib. In some embodiments, the hourglass shaped rib provides a greater surface area stiffness, by contacting a greater surface area of the sole and/or crown than the rectangular rib.

f. Example 6

The stability of the weight portion in a sixth club head was compared to the stability of the weight portion in the control club head upon impact with a golf ball. The sixth club head was similar to the club head 6000 described above and shown in FIG. 13. The sixth club head comprised a trussed crown to sole rib. The sixth club head rib comprised a substantially rectangular profile, similar to the second club head rib. The sixth club head rib comprised a constant width. The rib joined to the interior surfaces of the sole extension, the base structure, the weight channel top wall, the weight channel rear wall, and the crown bridge of the first metal component. The rib width was 0.46 inch. The rib thickness was 0.0025 inch.

The rib was positioned to protrude from the interior surface of the base structure between the heel boss and the center boss. Further, the rib was positioned in the rear 20% of the golf club head. The front end point of the rib along the interior surface of the sole portion was spaced bore than 4.5 inches from the front plane of the golf club head. The rear endpoint of the rib on the interior sole surface was spaced 0.25 inch from the skirt.

As illustrated in the graph of FIG. 16, an FEA analysis tracked the velocity of the weight portion, measured at the center of gravity of the weight portion, with respect to time in seconds after impact with a golf ball, for both the sixth club head and the control club head. The FEA analysis of the sixth club head resulted in a maximum weight portion velocity of roughly 10 inches per second. The control club head performed as described above for Example 1. When compared to the maximum velocity of the weight portion in the control club head, the velocity of the weight port in the sixth club head was decreased by 71%.

The truss structure of the sixth club head rib reduces the mass of the rib, while still supporting and stiffening the rear of the club head. The sixth club head does not decrease the weight portion velocity as much as the rectangular rib of Example 2. This slight reduction in performance could be attributed to a reduction of the structural integrity of the rib. The proximity of the truss apertures to the edges of the rib could contribute to the reduction in structural strength of the rib. In alternate embodiments, the truss apertures or structure can be concentrated within a central portion of the rib to increase the strength of the rib and more effectively brace against oscillations of the weight system.

g. Example 7

The stability of the weight portion in a seventh club head was compared to the stability of the weight portion in the control club head upon impact with a golf ball. The seventh club head was similar to the club head 5000 described above and shown in FIG. 12. The seventh club head comprised a perforated crown to sole rib. Specifically, the rib comprised circular perforations measuring 0.01 inch in diameter. Furthermore, the circular perforations or cutouts were arranged in a hexagonal fill pattern. Cutouts were localized in an area at least 0.25 inch above the sole extension portion.

The rib was positioned such that it protruded from the surface of the base structure between the heel boss and the center boss. The rib was positioned in the rear 20% of the golf club head. The front end point of the rib along the interior surface of the sole portion was spaced more 4.0 inches from the front plane of the club head. Additionally, the rear end point of the rib was spaced 0.25 inch from the skirt.

As illustrated in the graph of FIG. 16, an FEA analysis tracked the velocity of the weight portion, measured at the center of gravity of the weight portion, with respect to time in seconds after impact with a golf ball, for both the seventh club head and the control club head. The FEA analysis of the seventh club head resulted in a maximum weight portion velocity of roughly 6 inches per second. The control club head performed as described above for Example 1. When compared to the maximum velocity of the weight portion in the control club head, the velocity of the weight port in the seventh club head was decreased by 83%.

The circular perforated structure of the seventh club head rib reduces the mass of the rib, while still supporting and stiffening the rear of the club head. The seventh circular perforated rib decreases the velocity of the weight portion even more than the sixth trussed rib. The seventh club head rib decreases velocity of the weight portion almost as much as the rectangular second club head rib, while also reducing the weight of the rib. The circular perforated rib provides both structural strength and weight savings.

Clause 1: A golf club comprising a golf club head comprising a first component adhered to a second component to define a closed interior volume therebetween, the golf club head comprises a strikeface configured to strike a golf ball, a rear portion opposite the strikeface, a crown, a sole opposite the crown, a heel end, and a toe end opposite the heel end; wherein the first component comprises a crown return extending rearwardly from the strikeface, the crown return forming a portion of the crown; a sole return extending rearwardly form the strikeface, the sole return forming a portion of the sole; a sole extension extending rearwardly from the sole return and forming a portion of the sole; and a back rail connected to the sole extension; wherein the back rail comprises a top wall, a rear wall, and a lip; wherein the top wall, the rear wall, and the lip together define a channel extending along the back rail in a heel to toe direction; wherein the second component comprises a heel side wing that extends from the crown to the sole around the heel end of the club head; a toe side wing that extends from the crown to the sole around the toe end of the club head; wherein the sole extension extends a greater distance away from the strikeface, as measured in a direction from the strikeface to the rear, than the return; wherein the channel is configured to receive a weight portion of at least 14 grams; and wherein the first component comprises approximately 85% to 90% of an overall mass of the golf club head.

Clause 2: The golf club head of clause 1, wherein a rib is positioned on an interior surface of the closed interior volume of the club head.

Clause 3: The golf club head of clause 2, wherein the rib is positioned on the interior surface proximal to the back rail and sole extension.

Clause 4: The golf club head of clause 1, wherein the rib further comprises a rib height measured perpendicular to the interior surface of the sole extension.

Clause 5: The golf club head of clause 4, wherein the rib height increases in an arcuate manner in a front-to-rear direction.

Clause 6: The golf club head of clause 1, wherein the club head further comprises a crown bridge that is integrally formed with the crown return and the back rail and extends in strikeface-to-rear portion direction.

Clause 7: The golf club head of clause 6, wherein the rib extends from an interior surface of the sole extension to the crown bridge.

Clause 8: The golf club head of clause 7, wherein the rib is positioned within 20% of a rearmost point of the rear portion.

Clause 9: The golf club head of clause 7, wherein the rib is positioned within 10% of a rearmost point of the rear portion.

Clause 10: The golf club head of clause 7, wherein the rib forms a plurality of perforations.

Clause 11: A golf club comprising a golf club head comprising a first component adhered to a second component to define a closed interior volume therebetween, the golf club head comprises a strikeface configured to strike a golf ball, a rear portion opposite the strikeface, a crown, a sole opposite the crown, a heel end, and a toe end opposite the heel end; wherein the first component comprises a crown return extending rearwardly from the strikeface, the crown return forming a portion of the crown; a sole return extending rearwardly form the strikeface, the sole return forming a portion of the sole; a sole extension extending rearwardly from the sole return and forming a portion of the sole; and a back rail connected to the sole extension; wherein the back rail comprises a top wall, a rear wall, and a lip; wherein the top wall, the rear wall, and the lip together define a channel extending along the back rail in a heel to toe direction, and wherein the rear wall of the channel comprises a plurality of weight receiving bosses; wherein the second component comprises a heel side wing that extends from the crown to the sole around the heel end of the club head; a toe side wing that extends from the crown to the sole around the toe end of the club head; wherein the sole extension extends a greater distance away from the strikeface, as measured in a direction from the strikeface to the rear, than the return; wherein the channel is configured to receive a weight portion of at least 14 grams; wherein the first component comprises 85%-90% of an overall mass of the golf club head; and wherein a rib is positioned on an interior surface of the closed interior volume of the club head.

Clause 12: The club head of clause 11, wherein the rib extends between the weight receiving bosses and is integral with an interior surface of the back rail and sole extension.

Clause 13: The club head of clause 11, wherein the rib comprises a first arcuate surface extending from the crown bridge to the sole extension, the first arcuate surface being convex when viewed normal to the strikeface; wherein the rib comprises a second arcuate surface extending from the crown bridge to the sole extension, the second arcuate surface being concave when viewed normal to the strikeface.

Clause 14: The club head of clause 13, wherein the rib forms a plurality of perforations.

Clause 15: The club head of clause 14, wherein the plurality of perforations comprising a shape from the group consisting of: circular, triangular, square, pentagonal, hexagonal, trapezoidal, octagonal, and rectangular.

Clause 16: The club head of clause 11, wherein the first component and the second component define a lap joint or recessed lip therebetween; and wherein the second component is adhered to the first component across the lap.

Clause 17: The club head of clause 16, wherein the lap joint comprises a plurality of bond promoting features across a surface of the lap joint.

Clause 18: The club head of clause 11, wherein the rib extends across an entire width of the channel.

Clause 19: The club head of clause 11, wherein the second component comprises one or more thinned sections to reduce the overall weight of the second component.

Clause 20: The club head of clause 19, wherein the thinned sections are between 0.002 inch and 0.035 inch.

Clause 21: A method for forming a golf club head comprising forming a first component and a second component; wherein the first component is comprised of a metallic material and the second component is comprised of a composite material; coupling the first component to the second component forming a golf club head; wherein the golf club head comprises a strikeface, a crown, a sole, a heel end, a toe end, and a rear portion; wherein the first component comprises the strikeface, a crown return, a sole return, a sole extension, and a back rail; wherein the back rail further comprises a top wall, a rear wall, and a bottom lip; wherein the top wall, rear wall, and bottom lip define a channel; wherein the channel is configured to receive a weigh portion of at least 14 g; wherein the sole extension connects the sole return to the back rail; wherein the sole extension comprises an inner surface; wherein at least one rib spans from the sole extension inner surface to the back rail to join the sole extension inner surface, a top wall inner surface, and a rear wall inner surface; wherein the second component comprises a crown, a toe side wing, and a heel side wing; wherein the toe side wing and the heel side wing connect the crown to the sole; and wherein the first component comprises 85% to 90% of a golf club head total mass.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

The invention claimed is:

1. A golf club head comprising:

a first component adhered to a second component to define a closed interior volume therebetween;

a strikeface configured to strike a golf ball;

a rear portion opposite the strikeface;

a crown;

a sole opposite the crown;

a heel end; and a toe end opposite the heel end;

wherein the first component comprises:

a crown return extending rearwardly from the strikeface, the crown return forming a portion of the crown;

a sole return extending rearwardly from the strikeface, the sole return forming a portion of the sole;

a sole extension extending rearwardly from the sole return and forming a portion of the sole;

a back rail connected to the sole extension;

a skirt connected to the back rail; and a rib positioned on an interior surface of the golf club head;

wherein the back rail comprises a top wall, a rear wall, and a lip;

wherein the top wall, the rear wall, and the lip together define a channel extending along the back rail in a heel to toe direction;

wherein the rib comprises a lower front end point, a lower rear end point, an upper rear end point, a bottom edge extending from the lower front end point to the lower rear end point, and a top edge opposite the bottom edge; and wherein a rib height varies between the lower front end point and the lower rear end point;

wherein the second component comprises:

a crown portion;

a heel side wing that extends from the crown portion to the sole around the heel end of the golf club head;

a toe side wing that extends from the crown portion to the sole around the toe end of the golf club head;

wherein the channel is configured to receive a weight portion of at least 14 grams;

wherein the rib extends from the channel to the crown.

2. The golf club head of claim 1, wherein the sole extension extends a greater distance away from the strikeface, as measured in a direction extending rearwardly from the strikeface, than the crown return.

3. The golf club head of claim 1, wherein the rib height is between 0.45 inch and 0.75 inch.

4. The golf club head of claim 1, wherein the rib comprises a width defined as a horizontal distance between the lower front end point and the lower rear end point; and wherein said width is between 1.0 inch and 1.5 inches.

5. The golf club head of claim 1, wherein the rib comprises a rib thickness measured orthogonal to the rib height, in a heel-to-toe direction; wherein said rib thickness is between 0.0020 inch and 0.0075 inch.

6. The golf club head of claim 1, wherein the rib is further attached to the skirt.

7. The golf club head of claim 1, wherein the rib height varies from the lower front end point to the lower rear end point to define an arcuate profile of the top edge.

8. The golf club head of claim 6, wherein the rib further comprises a rear edge extending between the lower rear end point and the top edge; and wherein said rear edge abuts the skirt.

9. The golf club head of claim 8, wherein the top edge of the rib comprises a radius of curvature between 1.0 inch and 2.0 inches.

10. The golf club head of claim 1, wherein the first component is comprised of a metallic material and the second component is comprised of a composite material.

11. The golf club head of claim 1, wherein the rib height increases between the lower front end point and the lower rear end point.

12. A golf club head comprising:

a first component adhered to a second component to define a closed interior volume therebetween;

a strikeface configured to strike a golf ball;

a rear portion opposite the strikeface;

a crown;

a sole opposite the crown;

a heel end; and a toe end opposite the heel end;

wherein the first component comprises:

a crown return extending rearwardly from the strikeface, the crown return forming a portion of the crown;

a sole return extending rearwardly from the strikeface, the sole return forming a portion of the sole;

a sole extension extending rearwardly from the sole return and forming a portion of the sole;

a back rail connected to the sole extension;

a skirt connected to the back rail; and a first rib and a second rib protruding from an interior surface of the golf club head;

wherein the back rail comprises a top wall, a rear wall, a lip, and a plurality of weight receiving bosses;

wherein the top wall, the rear wall, and the lip together define a weight channel extending along the back rail in a heel to toe direction;

wherein each of the first rib and the second rib comprise a lower front end point, a lower rear end point, an upper rear end point, a bottom edge extending from the lower front end point to the lower rear end point, and a top edge, opposite the bottom edge; and wherein a rib height of the first rib and a rib height of the second rib varies between the respective lower front end point and the lower rear end point of each of the first rib and the second rib;

wherein the first rib and the second rib extend in between the weight receiving bosses;

wherein the plurality of weight receiving bosses are configured to retain a weight portion of at least 14 grams;

wherein the first rib and the second rib extend from the weight receiving bosses to the crown.

13. The golf club head of claim 12, wherein the rib height of each of the first rib and the second rib varies such that the top edge of each of the first rib and the second rib comprises an arcuate profile.

14. The golf club head of claim 12, wherein the plurality of weight receiving bosses comprises a toe boss, proximate to the toe end, a heel boss, proximate to the heel end, and a center boss between the toe boss and the heel boss.

15. The golf club head of claim 14, wherein the first rib protrudes from an interior surface of the sole extension and from an interior surface of the weight channel between the toe boss and the center boss, and the second rib protrudes from the interior surface of the sole extension and from the interior surface of the weight channel between the heel boss and the center boss.

16. The golf club head of claim 15, wherein a rear edge of each of the first rib and the second rib extends from the respective lower rear end point and the upper rear end point of each of the first rib and the second rib and abuts the skirt.

17. The golf club head of claim 15, wherein each of the first rib and the second rib connects the interior surface of the sole extension with the interior surface of the weight channel and are configured to control a velocity of the weight portion during impact.

18. The golf club head of claim 12, wherein the lower front end point of each of the first rib and the second rib is positioned in a rear 35% of a length of the golf club head.

19. The golf club head of claim 12, wherein the rib height of each of the first rib and the second rib increases between the respective lower front end point and the lower rear end point of each of the first rib and the second rib.

* * * * *